US009903238B2

(12) United States Patent
Tolbert et al.

(10) Patent No.: US 9,903,238 B2
(45) Date of Patent: Feb. 27, 2018

(54) ROTARY VALVE ASSEMBLY HAVING ROTATABLE THROTTLE AND INTAKE ASSEMBLIES

(71) Applicant: MICROSTEAM, INC., Kennesaw, GA (US)

(72) Inventors: Joshua A. Tolbert, Smyrna, GA (US); Benjamin J. Tolbert, Atlanta, GA (US)

(73) Assignee: MICROSTEAM, INC., Kennesaw, GA (US)

( * ) Notice: Subject to any disclaimer, the term of this patent is extended or adjusted under 35 U.S.C. 154(b) by 16 days.

(21) Appl. No.: 15/040,461

(22) Filed: Feb. 10, 2016

(65) Prior Publication Data

US 2016/0230617 A1 Aug. 11, 2016

Related U.S. Application Data

(63) Continuation-in-part of application No. 14/619,522, filed on Feb. 11, 2015.

(51) Int. Cl.
*F01L 7/02* (2006.01)
*F01B 17/04* (2006.01)
(Continued)

(52) U.S. Cl.
CPC ..... *F01L 7/023* (2013.01); *F01B 17/04* (2013.01); *F01K 7/00* (2013.01); *F01L 7/027* (2013.01);
(Continued)

(58) Field of Classification Search
CPC ..... F01L 7/00–7/18
(Continued)

(56) References Cited

U.S. PATENT DOCUMENTS 676,179 A * 6/1901 Elliott ..... B62D 5/097 137/625.24
1,530,390 A 3/1925 Hawthorne
(Continued)

FOREIGN PATENT DOCUMENTS

FR 573 745 A 6/1924
GB 191402257 A * 0/1915 ..... F01L 7/027
(Continued)

OTHER PUBLICATIONS http://coatesengine.com/csrv-system.html; "The Coates Speherical Roatary Valve (CSRV) System;" CSRV System—Coates International Ltd.; Retrieved Nov. 26, 2014.
(Continued)

*Primary Examiner* — Laert Dounis
(74) *Attorney, Agent, or Firm* — Womble Bond Dickinson (US) LLP

(57) ABSTRACT

Provided herein are rotary valve assemblies, engines, and corresponding methods. A rotary valve assembly may include a valve housing defining a cylindrical bore, an inlet, and an outlet. The valve assembly may further include an intake assembly and a throttle assembly arranged concentrically within the cylindrical bore of the valve housing, and the intake assembly and the throttle assembly may rotate independently of one another with respect to a longitudinal axis. During operation of the rotary valve assembly, the valve housing may permit fluid to enter the cylindrical bore of the valve housing via the inlet, the intake assembly may rotate to permit the fluid to flow through the at least one intake inlet port and the at least one throttle inlet port into the throttle body, and the intake assembly may permit the fluid to flow to the outlet from the throttle body.

18 Claims, 27 Drawing Sheets

(51) Int. Cl.
*F01K 7/00* (2006.01)
*F01K 13/00* (2006.01)

(52) U.S. Cl.
CPC ..... *F01B 2250/001* (2013.01); *F01K 13/006* (2013.01)

(58) Field of Classification Search
USPC ..... 137/625.15, 625.21, 630, 630.21, 637.5; 251/345; 60/641.1–681
See application file for complete search history.

(56) References Cited

U.S. PATENT DOCUMENTS

| | | | | | |
|---|---|---|---|---|---|
| 2,289,203 | A | | 7/1942 | McGrew | |
| 2,839,888 | A | | 6/1958 | Mallory | |
| 2,989,955 | A | | 6/1961 | Dunne | |
| 3,650,295 | A | | 3/1972 | Smith | |
| 3,948,227 | A | * | 4/1976 | Guenther | F01L 7/021 123/190.16 |
| 4,370,955 | A | | 2/1983 | Ruggeri | |
| 4,473,041 | A | | 9/1984 | Lyons et al. | |
| 4,481,917 | A | * | 11/1984 | Rus | F01L 7/045 123/190.12 |
| 4,852,532 | A | | 8/1989 | Bishop | |
| 4,976,227 | A | | 12/1990 | Draper | |
| 5,152,259 | A | | 10/1992 | Bell | |
| 5,205,251 | A | | 4/1993 | Conklin | |
| 5,255,645 | A | | 10/1993 | Templeton | |
| 5,267,535 | A | | 12/1993 | Luo | |
| 5,579,734 | A | | 12/1996 | Muth | |
| 5,706,775 | A | | 1/1998 | Schweter et al. | |
| 6,443,110 | B2 | | 9/2002 | Qattan | |
| 6,691,664 | B2 | | 2/2004 | Pisano et al. | |
| 7,044,097 | B2 | | 5/2006 | Wright | |
| 7,140,342 | B1 | | 11/2006 | Murray | |
| 7,694,656 | B2 | | 4/2010 | Thomas | |
| 8,572,969 | B1 | | 11/2013 | Home | |
| 2002/0139342 | A1 | | 10/2002 | Trentham | |
| 2008/0236535 | A1 | | 10/2008 | Van Driessche et al. | |
| 2012/0047884 | A1 | | 3/2012 | McBride et al. | |

FOREIGN PATENT DOCUMENTS

| | | | | | |
|---|---|---|---|---|---|
| GB | 193919 | A | * | 3/1923 | F01L 7/045 |
| GB | 180313 | A | * | 7/1923 | F01L 7/027 |
| GB | 461 488 | A | | 2/1937 | |
| GB | 2226597 | A | | 7/1990 | |
| WO | WO 97/39225 | A | | 10/1997 | |
| WO | WO 2000 073632 | A1 | | 12/2000 | |

OTHER PUBLICATIONS http://www.pattakon.com/pattakonpatrova.htm; Title: PatRoVa: a disk Rotary Valve with Counteracting Fonts; Retrieved Nov. 26, 2014.

International Search Report and Written Opinion for Application No. PCT/IB2016/050731 dated May 17, 2016.

Lyon, Robert L. "The Steam Car Fact and Fantasy." Steam Automobile, vol. 13, No. 3, 1971, p. 7.

Office Action from U.S. Appl. No. 14/619,522, dated Aug. 4, 2016, 33 pages.

Office Action from U.S. Appl. No. 14/619,522, dated Dec. 27, 2016.

Office Action from U.S. Appl. No. 14/619,522, dated May 26, 2017, 33 pages.

* cited by examiner

ROTARY VALVE ASSEMBLY HAVING ROTATABLE THROTTLE AND INTAKE ASSEMBLIES

CROSS-REFERENCE TO RELATED APPLICATIONS

This application is a continuation-in-part of U.S. application Ser. No. 14/619,522 filed Feb. 11, 2015, titled "Practical Steam Engine," which application is incorporated by reference herein in its entirety.

BACKGROUND

Many forms of power generation in thermal-fluid systems use engines for converting expansive pressure into mechanical and/or electrical power. Various engines have specific advantages and disadvantages when compared. Turbine engines offer advantages of high speed operation and high power density. However, turbines often suffer from an inability to efficiently operate in varying flow conditions. Non-turbine engines (e.g., traditional steam engines) have advantages of being very capable of operating efficiently in varying flow conditions but typically operate at very slow speeds resulting in relatively low power outputs. A desirable combination is a high speed engine design that would allow the efficient operation at varying flow conditions while producing high power outputs. One of the primary reasons for past failures to cure this deficiency is the inability to get the working fluid in and out of the engine fast enough and efficiently enough to allow this high speed operation. One major limitation of the speed of the exchange process is the valvetrain.

Applicant has identified a number of additional deficiencies and problems associated with conventional valvetrains and other associated systems and methods. Through applied effort, ingenuity, and innovation, many of these identified problems have been solved by developing solutions that are included in embodiments of the present invention, many examples of which are described in detail herein.

BRIEF SUMMARY OF THE INVENTION

Generally, some embodiments provided herein include rotary valve assemblies, valvetrains, engines, and associated methods. A rotary valve assembly may include a valve housing defining a cylindrical bore, an inlet, and an outlet. The rotary valve assembly may include an intake assembly configured to be at least partially received within the cylindrical bore of the valve housing. The intake assembly may include an intake body defining a cylindrical bore and having at least one intake inlet port and at least one intake chamber port. The rotary valve assembly may further include a throttle assembly configured to be at least partially received within the cylindrical bore of the intake assembly. The throttle assembly may include a throttle body defining at least one throttle inlet port and at least one throttle chamber port. The throttle assembly and the intake assembly may be concentric with respect to a longitudinal axis. In some embodiments, the throttle assembly and the intake assembly may be configured to rotate independently of one another about the longitudinal axis. The at least one intake chamber port and the at least one throttle chamber port may at least partially overlap in a longitudinal direction. The at least one intake inlet port and the at least one throttle inlet port may at least partially overlap in the longitudinal direction. In some embodiments, during operation of the rotary valve assembly, the valve housing may be configured to permit fluid to enter the cylindrical bore of the valve housing via the inlet. The intake assembly may be configured to rotate to permit the fluid to flow through the at least one intake inlet port and the at least one throttle inlet port into the throttle body. The intake assembly may be configured to permit the fluid to flow to the outlet from the throttle body through the at least one throttle chamber port and the at least one intake chamber port.

In some embodiments, the at least one intake chamber port may include at least two intake chamber ports spaced symmetrically about a circumference of the intake body. The at least one throttle chamber port may include one throttle chamber port.

The at least one intake chamber port may be spaced from the at least one intake inlet port in the longitudinal direction. In some embodiments, the at least one intake chamber ports may include a greater number of ports than the at least one throttle chamber port.

In some embodiments, the rotary valve assembly may include at least one throttle bearing between the intake body and the throttle body, and may include at least one seal between the at least one throttle bearing and at least one of the at least one intake inlet port, the at least one throttle inlet port, the at least one intake chamber port, or the at least one throttle chamber port. The rotary valve assembly may further include vents disposed between the at least one throttle bearing and the at least one seal. The vents may be to apply a vacuum between the at least one throttle bearing and the at least one seal.

Some embodiments of the rotary valve assembly may include a first pair of bearings between the bore of the valve housing and the intake assembly at a first end of the intake assembly, and a second pair of bearings between the bore of the valve housing and the intake assembly at a second end of the intake assembly. In some embodiments, the rotary valve assembly may include at least one seal between the at least one of the first pair of bearings or the second pair of bearings and at least one of the at least one intake inlet port, the at least one throttle inlet port, the at least one intake chamber port, or the at least one throttle chamber port. The rotary valve assembly may further include vents disposed between the at least one of the first pair of bearings or the second pair of bearings and the at least one seal. The vents may be configured to apply a vacuum between the at least one of the first pair of bearings or the second pair of bearings and the at least one seal.

In some embodiments, the rotary bushing disposed between the valve housing and a rear end of the throttle assembly.

In some other embodiments, an engine may be provided that includes a rotary valve assembly. The rotary valve assembly may include a valve housing defining a cylindrical bore, an inlet, and an outlet. The rotary valve assembly may further include an intake assembly configured to be at least partially received within the cylindrical bore of the valve housing. The intake assembly may include an intake body defining a cylindrical bore and having at least one intake inlet port and at least one intake chamber port. The rotary valve assembly may include a throttle assembly configured to be at least partially received within the cylindrical bore of the intake assembly. The throttle assembly may include a throttle body defining at least one throttle inlet port and at least one throttle chamber port. The throttle assembly and the intake assembly may be concentric with respect to a longitudinal axis. The throttle assembly and the intake assembly may be configured to rotate independently of one another about the longitudinal axis. The at least one intake chamber port and the at least one throttle chamber port may at least partially overlap in a longitudinal direction. The at least one intake inlet port and the at least one throttle inlet port may at least partially overlap in the longitudinal direction. The engine may further include a chamber housing comprising a chamber therein. The valve housing may be rigidly attached to the chamber housing. The rotary valve assembly may be in fluid communication with the chamber via the valve housing chamber port. In some embodiments, during operation of the engine, the valve housing may be configured to permit fluid to enter the cylindrical bore of the valve housing via the inlet. The intake assembly may be configured to rotate to permit the fluid to flow through the at least one intake inlet port and the at least one throttle inlet port into the throttle body. The intake assembly may be configured to permit the fluid to flow to the outlet and into the chamber from the throttle body through the at least one throttle chamber port and the at least one intake chamber port.

In some embodiments, the engine may consists of at least one of a uniflow engine, a semi-uniflow engine, or a counter flow engine.

Some embodiments of the engine may further include at least one throttle bearing between the intake body and the throttle body. The engine may include at least one seal between the at least one throttle bearing and at least one of the at least one intake inlet port, the at least one throttle inlet port, the at least one intake chamber port, or the at least one throttle chamber port. The engine may further include vents disposed between the at least one throttle bearing and the at least one seal. The vents may be configured to apply a vacuum between the at least one throttle bearing and the at least one seal.

In some embodiments, the engine may include a first pair of bearings between the bore of the valve housing and the intake assembly at a first end of the intake assembly, and a second pair of bearings between the bore of the valve housing and the intake assembly at a second end of the intake assembly. The rotary valve assembly may further include at least one seal between the at least one of the first pair of bearings or the second pair of bearings and at least one of the at least one intake inlet port, the at least one throttle inlet port, the at least one intake chamber port, or the at least one throttle chamber port. In some embodiments, the rotary valve assembly may further include vents disposed between the at least one of the first pair of bearings or the second pair of bearings and the at least one seal. The vents may be configured to apply a vacuum between the at least one of the first pair of bearings or the second pair of bearings and the at least one seal.

The valve housing may further include an exhaust cylindrical bore. The rotary valve assembly may further include an exhaust assembly configured to be at least partially received within the exhaust cylindrical bore of the valve housing. The exhaust assembly may include an exhaust body defining a cylindrical bore and may have at least one exhaust outlet port and at least one exhaust chamber port.

In some embodiments, the valve housing of the rotary valve assembly and the chamber housing may be integrally connected.

In yet another embodiment, a method for controlling flow of a working fluid into an engine chamber using a rotary valve assembly may be provided. The rotary valve assembly may include a valve housing defining a cylindrical bore, an inlet, and an outlet. The rotary valve assembly may further include an intake assembly configured to be at least partially received within the cylindrical bore of the valve housing. The intake assembly may include an intake body defining a cylindrical bore and may have at least one intake inlet port and at least one intake chamber port. The rotary valve assembly may further include a throttle assembly configured to be at least partially received within the cylindrical bore of the intake assembly. The throttle assembly may include a throttle body defining at least one throttle inlet port and at least one throttle chamber port. The throttle assembly and the intake assembly may be concentric with respect to a longitudinal axis. The throttle assembly and the intake assembly may be configured to rotate independently of one another about the longitudinal axis. The at least one intake inlet port and the at least one throttle inlet port may at least partially overlap in the longitudinal direction. The at least one intake chamber port and the at least one throttle chamber port may at least partially overlap in a longitudinal direction. Some embodiments of the method may include receiving working fluid into the bore of the valve housing through the inlet. The intake assembly may be disposed in the bore. The method may further include rotating the intake body of the rotary valve in the bore such that the at least one intake inlet port of the inlet assembly may at least partially aligns with the inlet of the valve housing and the at least one throttle inlet port to receive the working fluid within the throttle body. In some embodiments, during the rotation of the intake body of the intake assembly, the at least one intake chamber port at least partially aligns with the at least one throttle chamber port and the outlet of the valve housing. In some embodiments, when the at least one intake chamber port, the at least one throttle chamber port, and the outlet of the valve housing at least partially align, the working fluid may be directed into the engine chamber.

In some embodiments, the throttle assembly may be generally stationary during rotation of the intake body, such that the intake body rotates relative to the bore of the valve housing and the throttle assembly. The throttle assembly may be configured to be rotated independently of the intake body during operation to control cutoff of the rotary valve assembly.

In some embodiments of the method, rotating the intake body may further include rotating the intake body at a rotational speed less than or equal to a rotational speed of an output power shaft of the engine.

In some embodiments, the rotary valve assembly may further include at least one throttle bearing between the intake body and the throttle body. The rotary valve assembly may include at least one seal between the at least one throttle bearing and at least one of the at least one intake inlet port, the at least one throttle inlet port, the at least one intake chamber port, or the at least one throttle chamber port. The rotary valve assembly may further include vents disposed between the at least one throttle bearing and the at least one seal. Some embodiments of the method may further include applying a vacuum via the vents between the at least one throttle bearing and the at least one seal.

BRIEF DESCRIPTION OF THE SEVERAL VIEWS OF THE DRAWINGS

Figure 1:
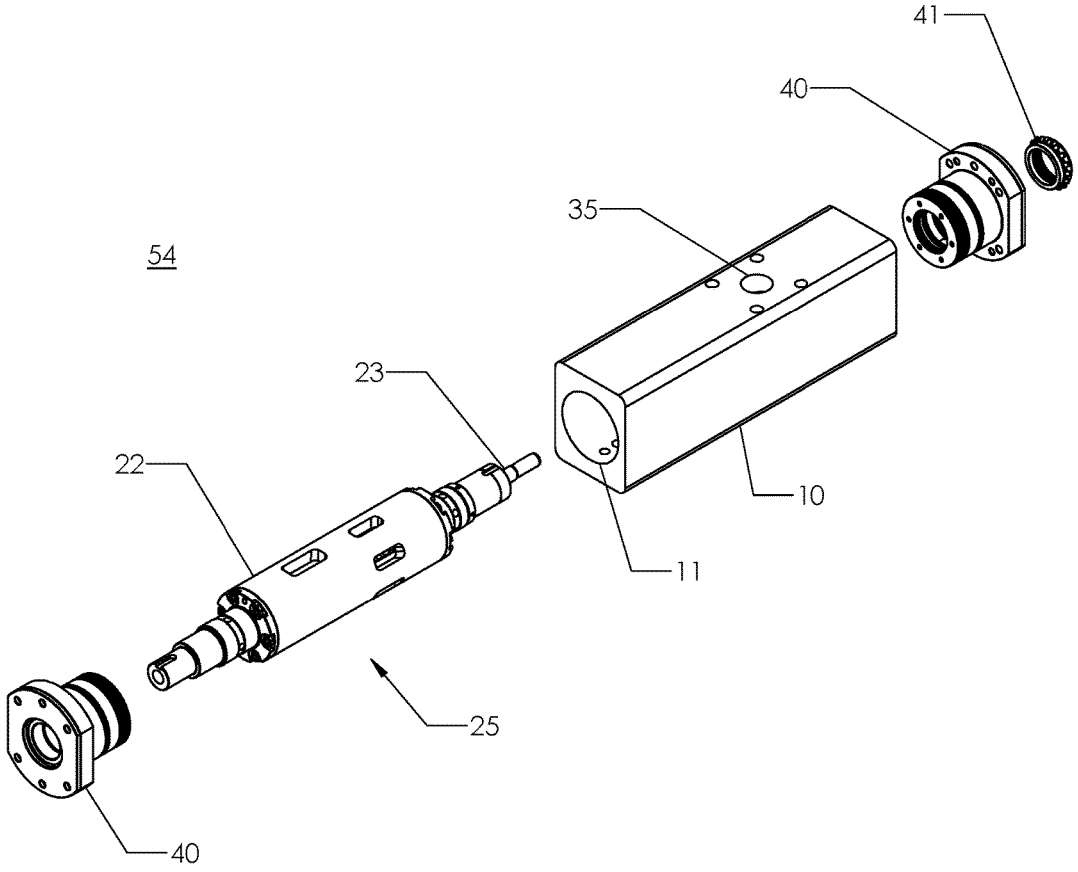
Figure 2:
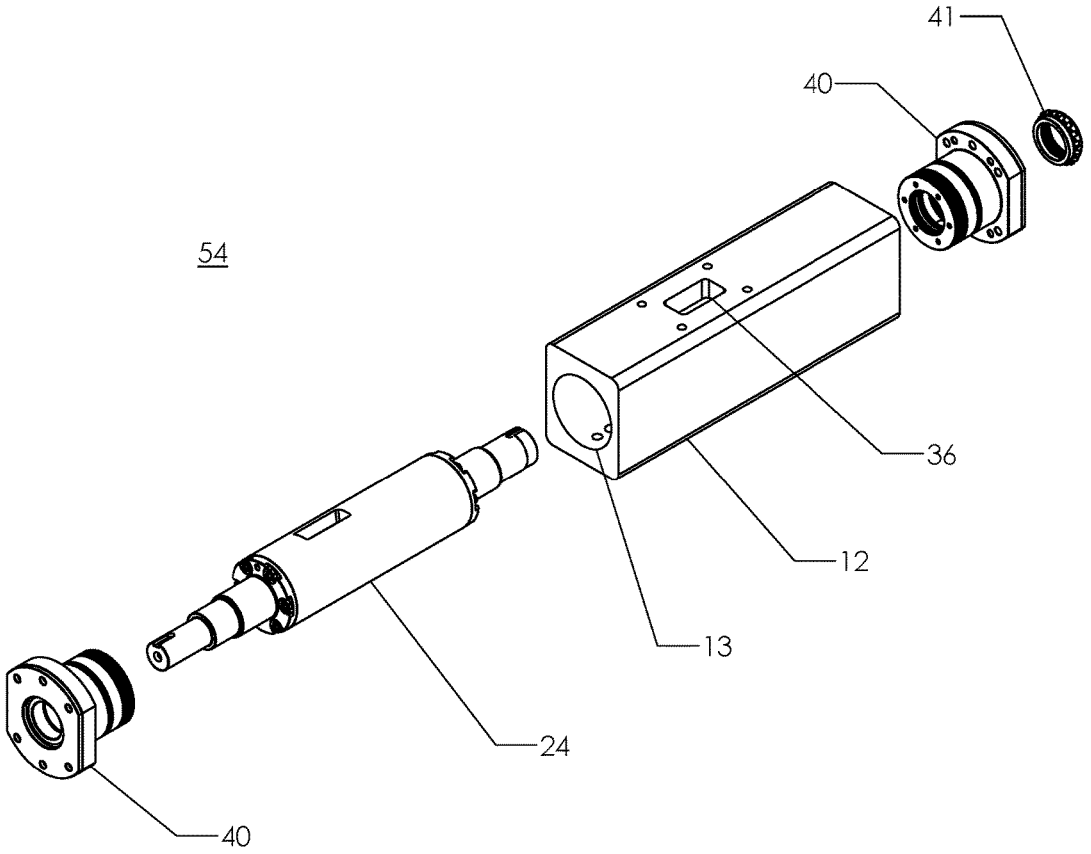
Figure 3:
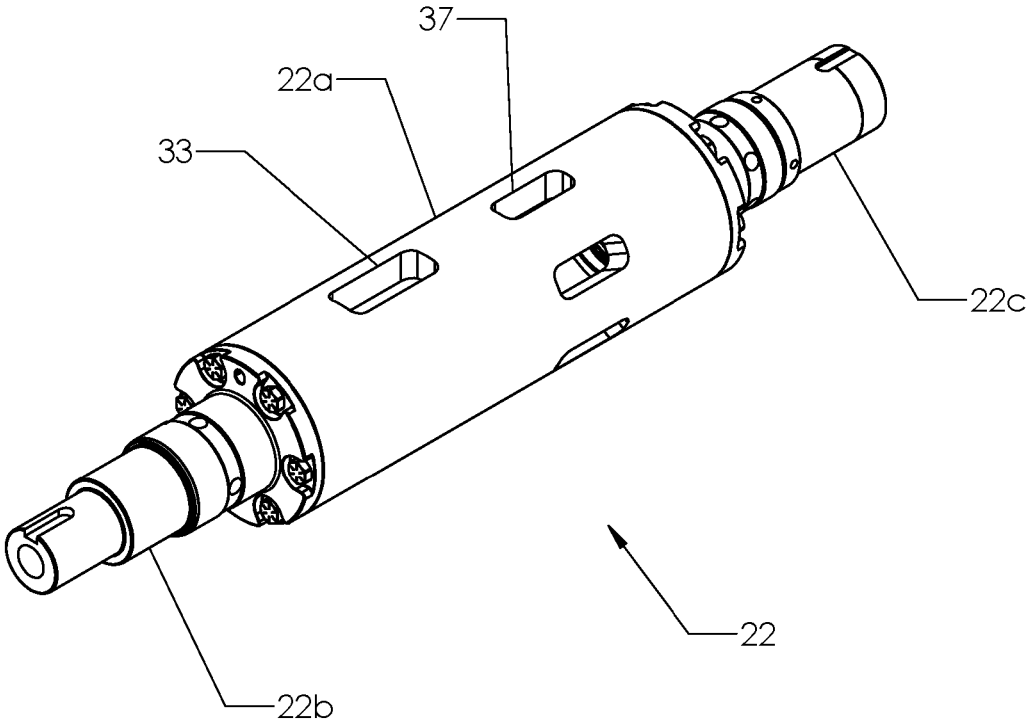
Figure 4:
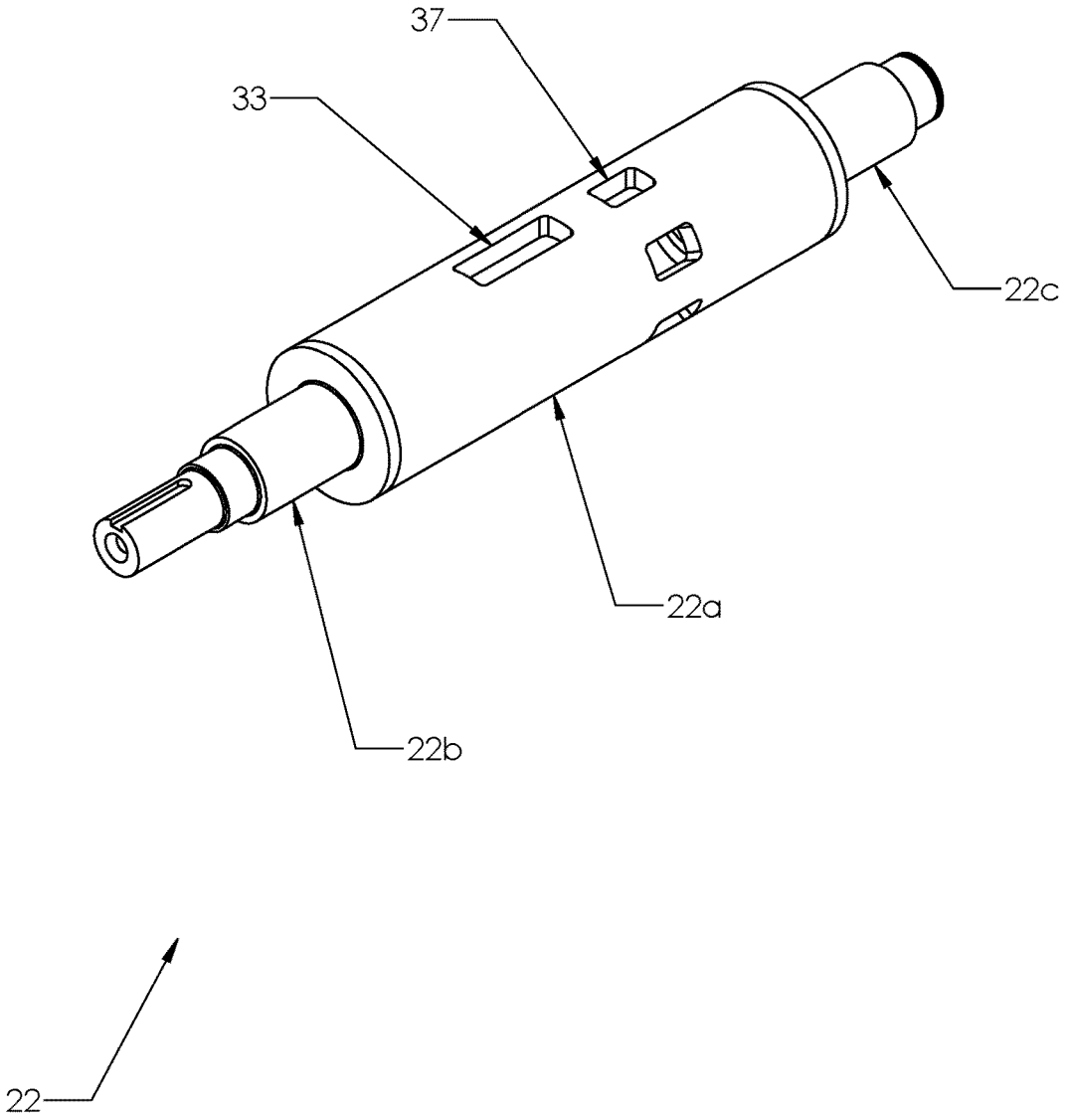
Figure 5:
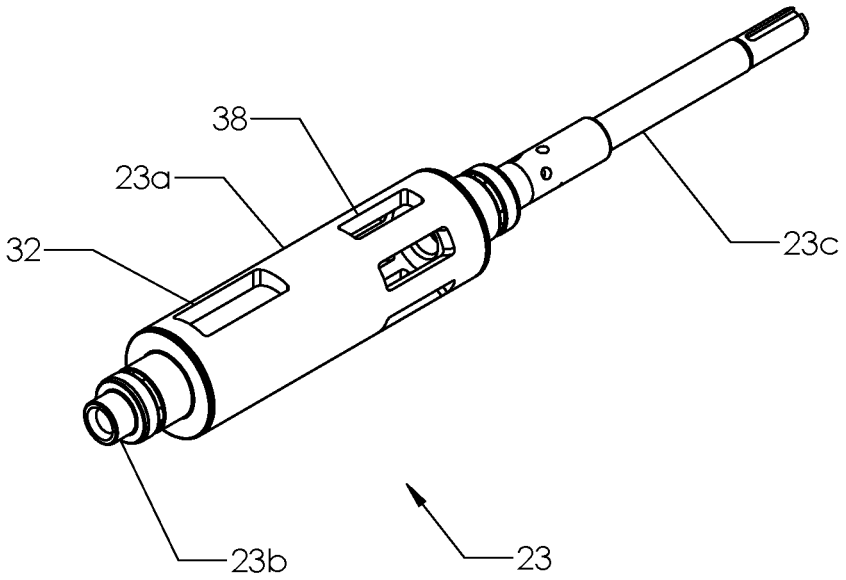
Figure 6:
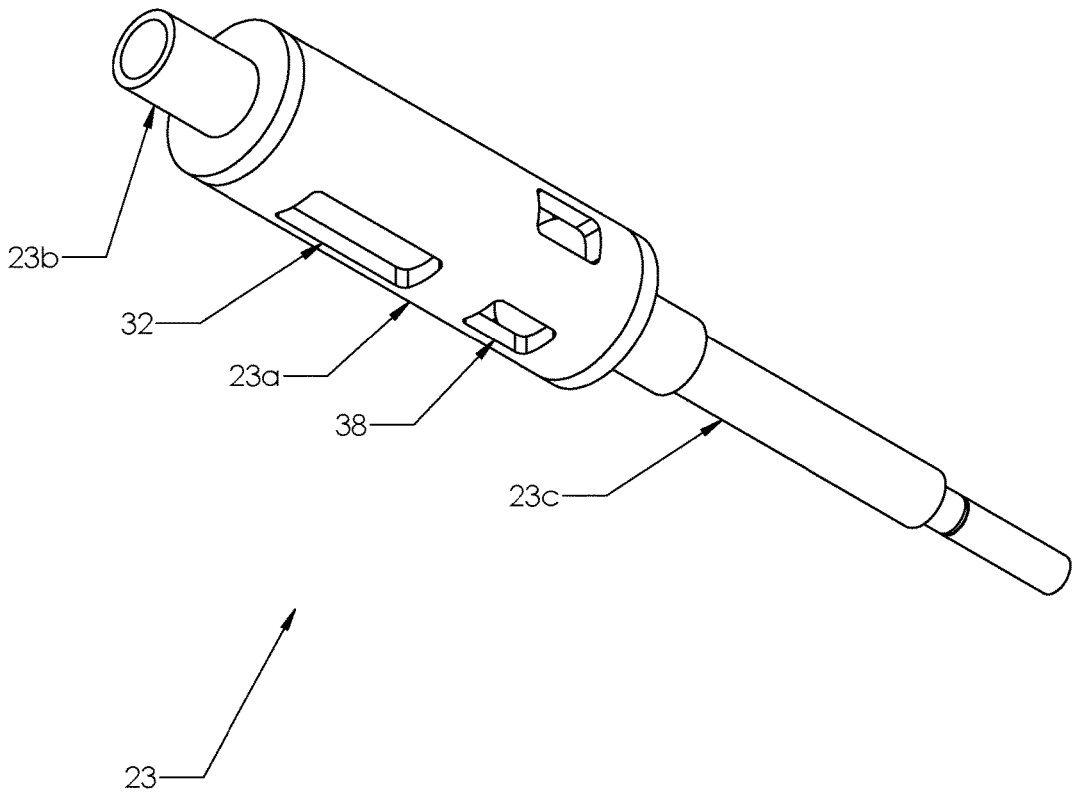
Figure 7:
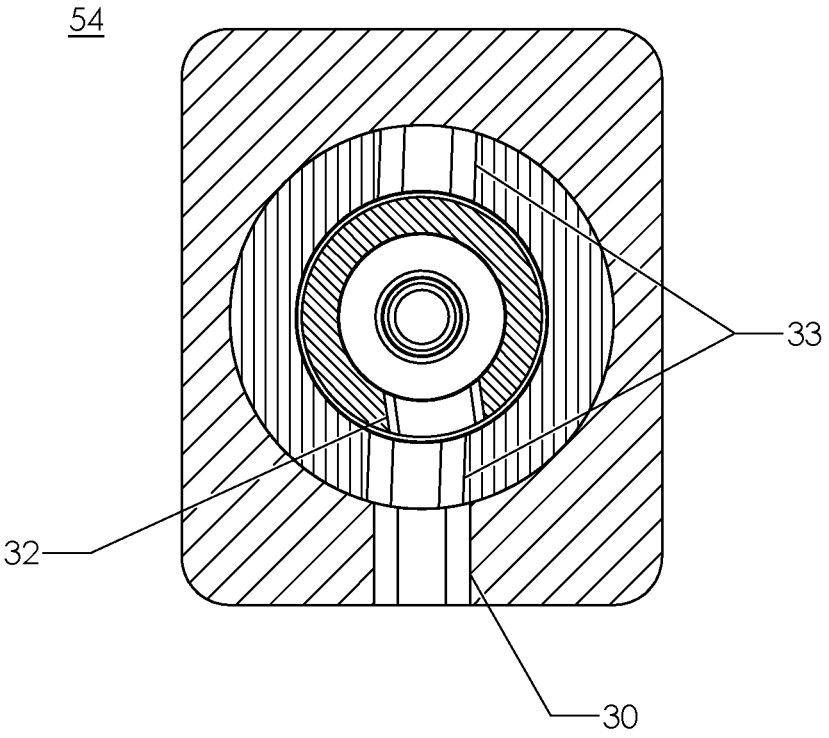
Figure 8:
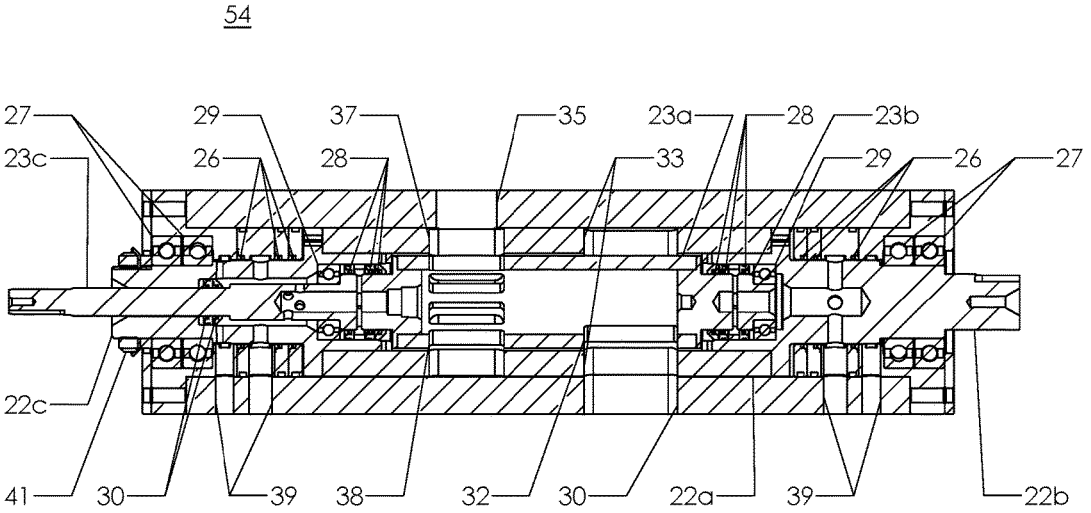
Figure 9:
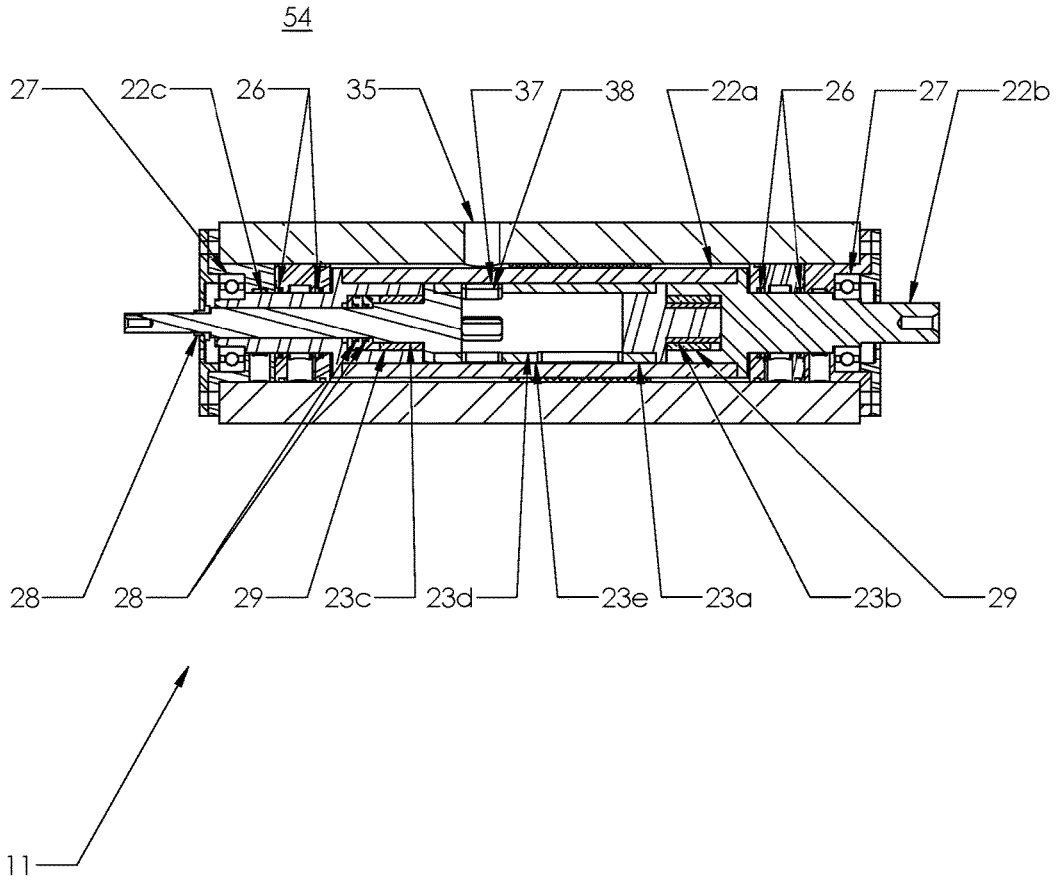
Figure 10:
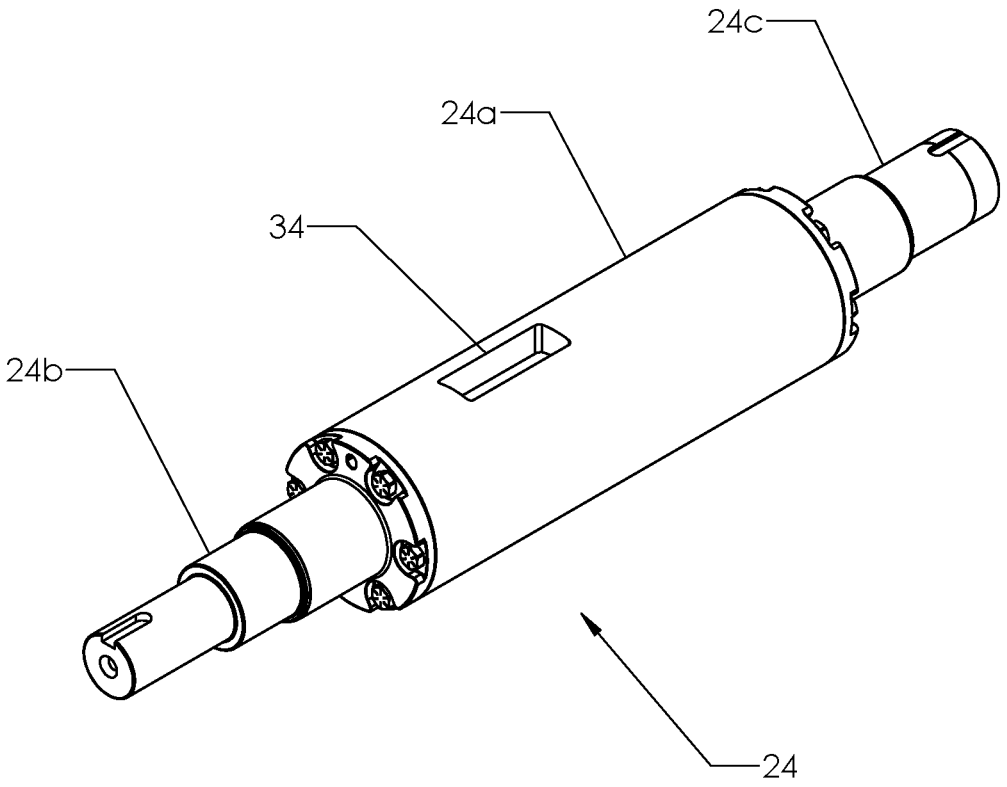
Figure 11:
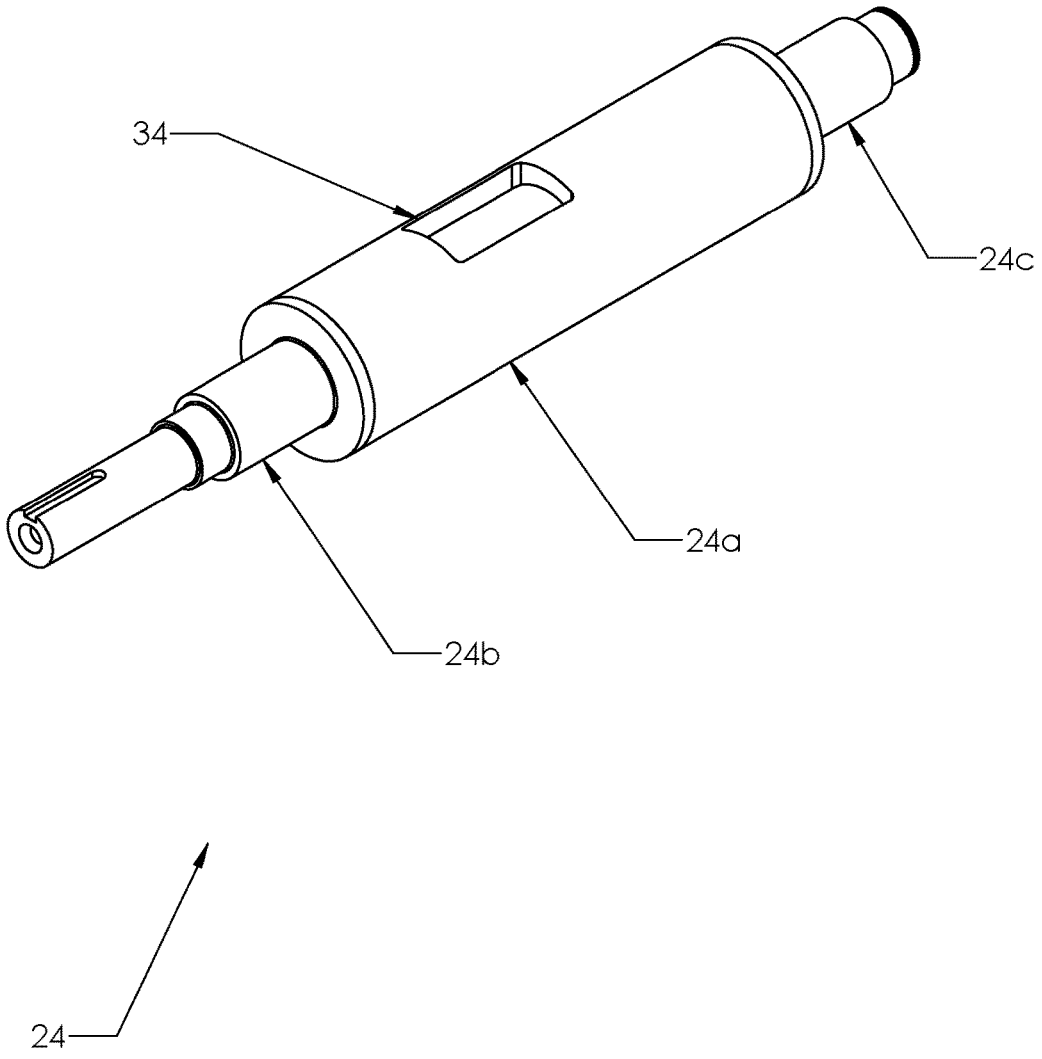
Figure 12:
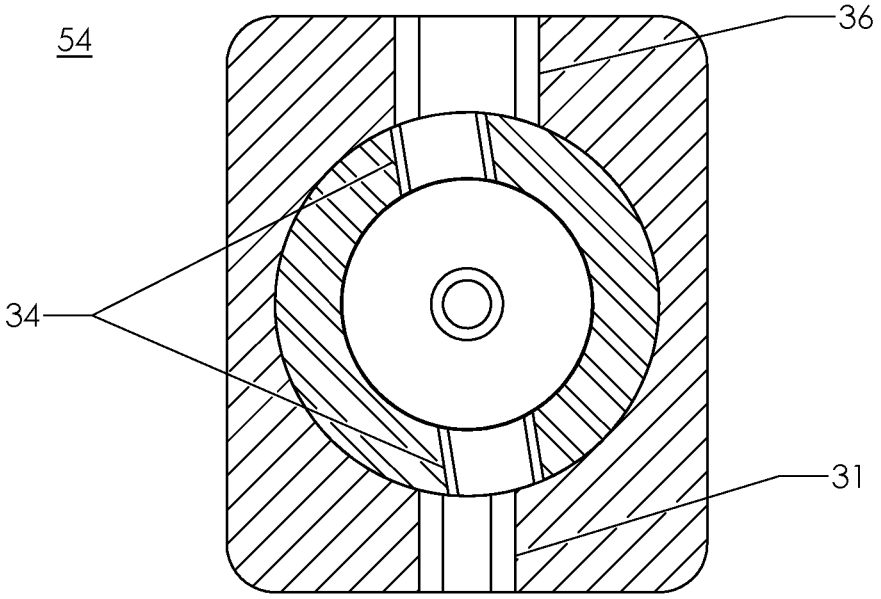
Figure 13:
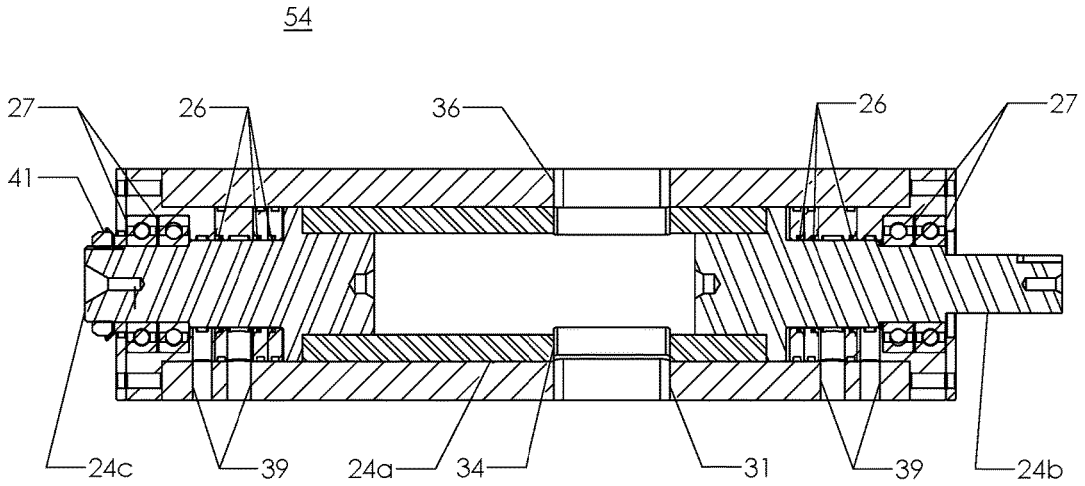
Figure 14:
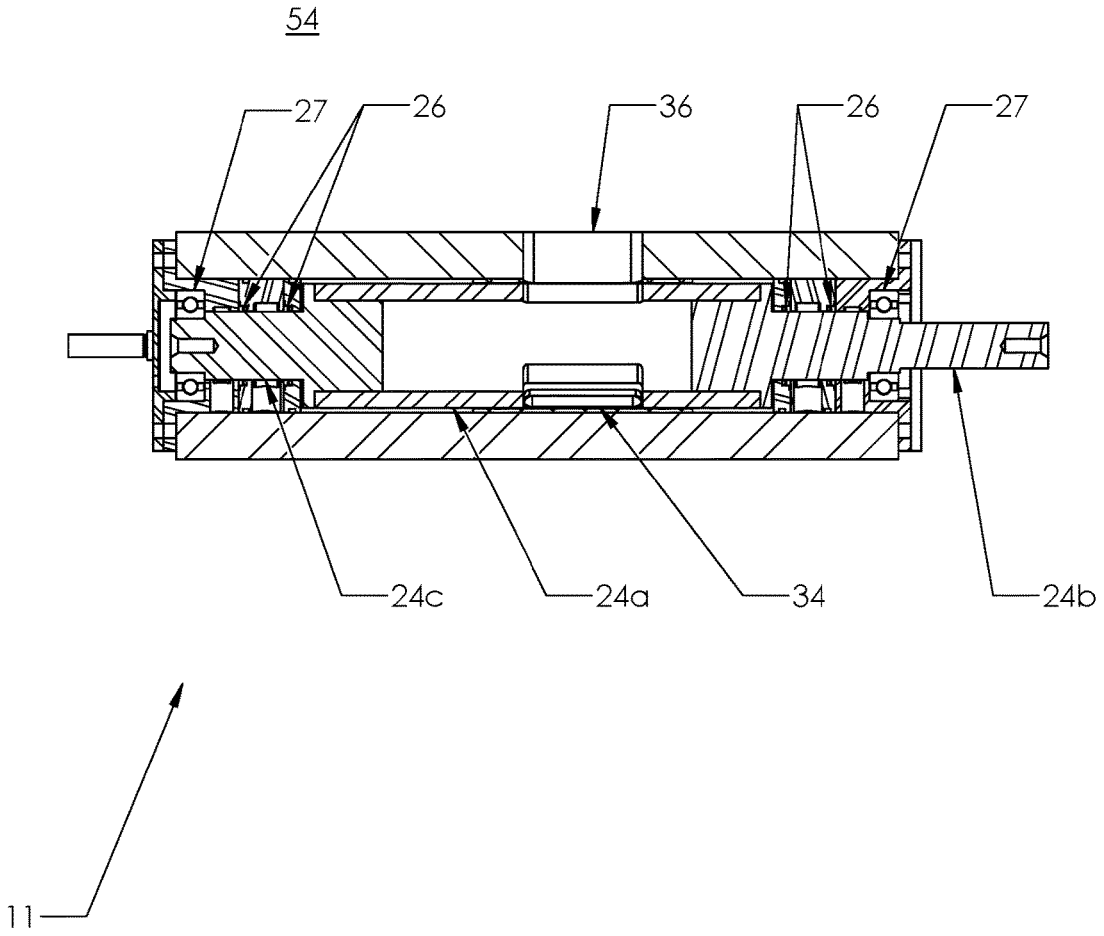
Figure 15:
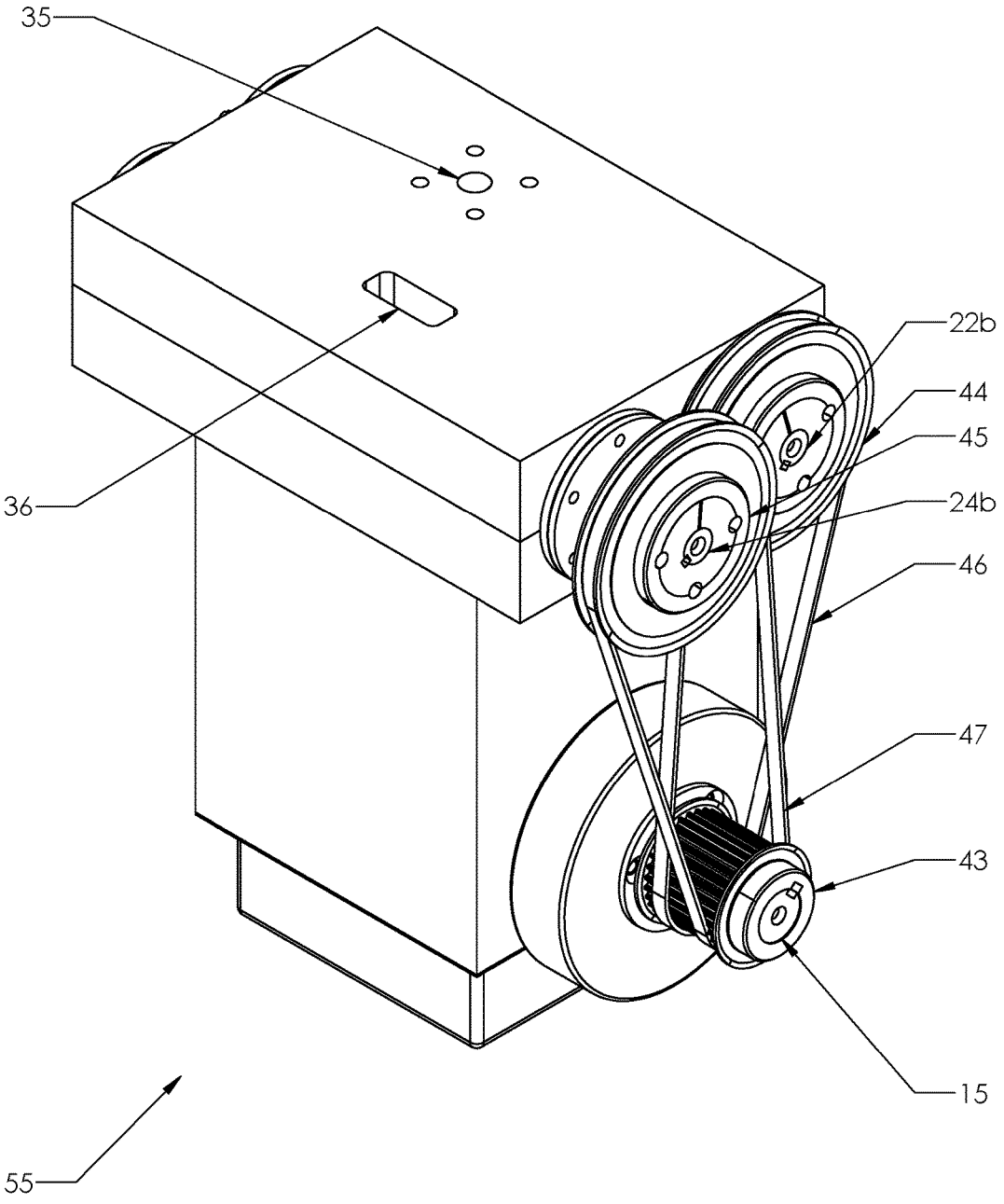
Figure 16:
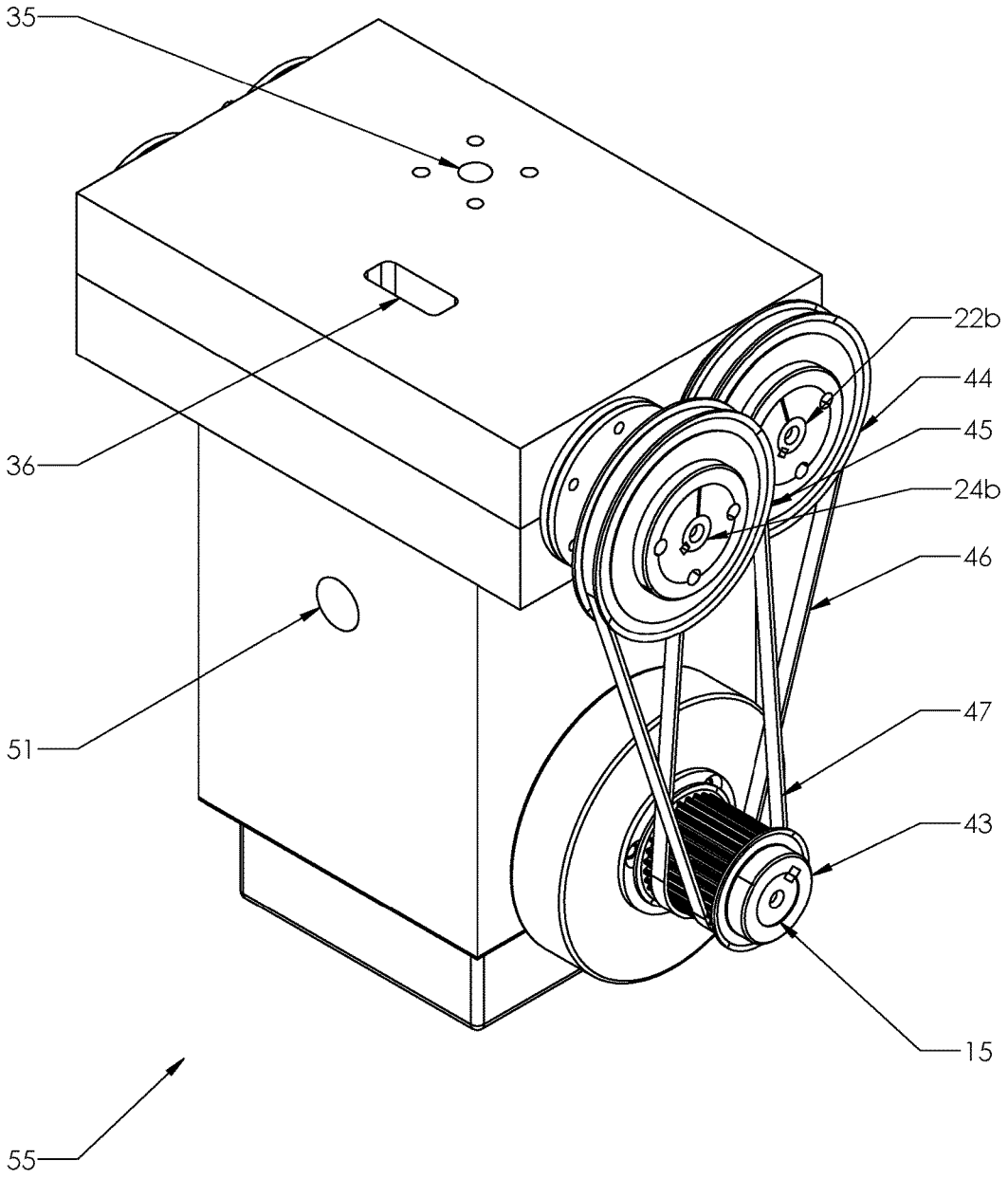
Figure 17:
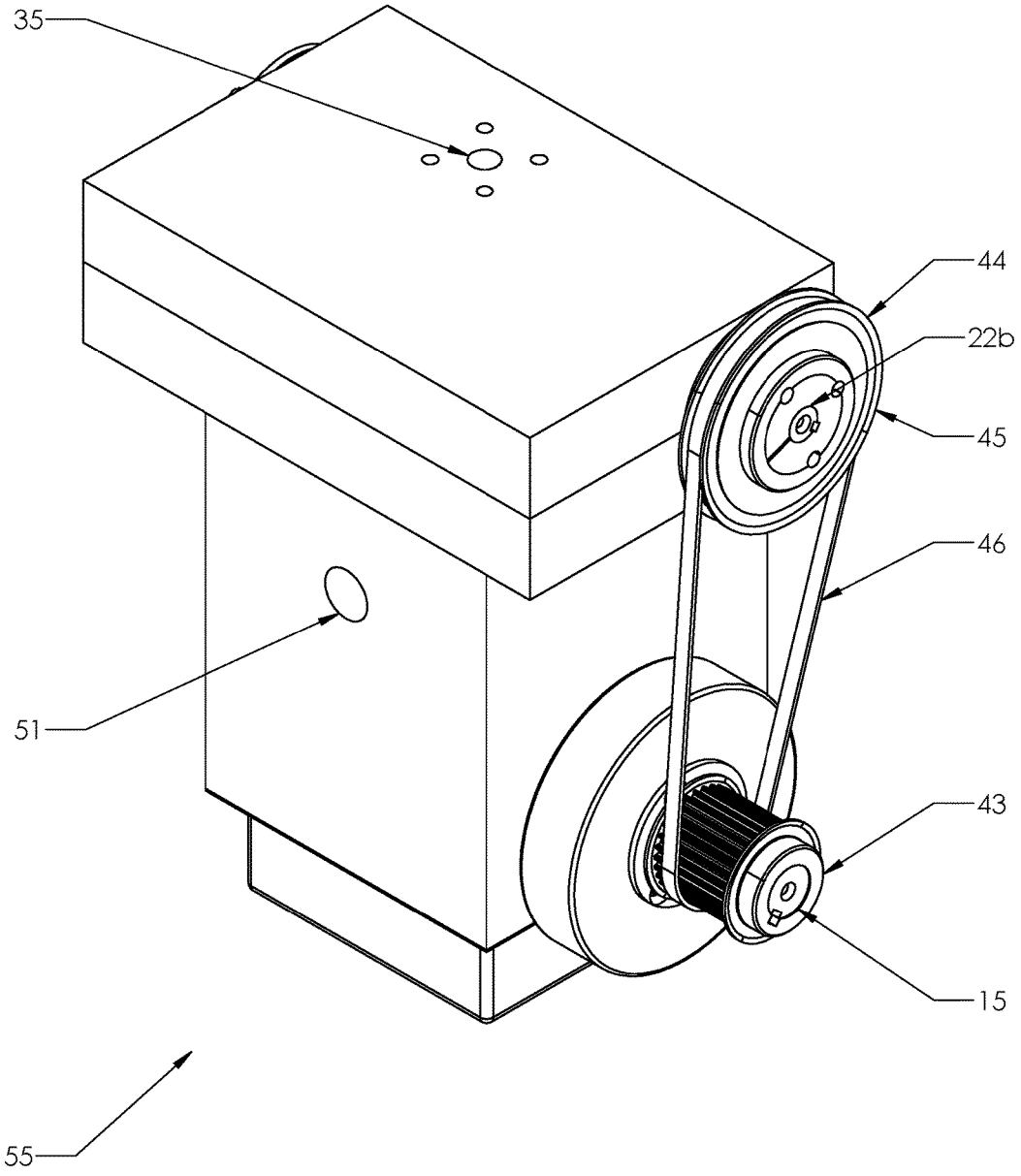
Figure 18:
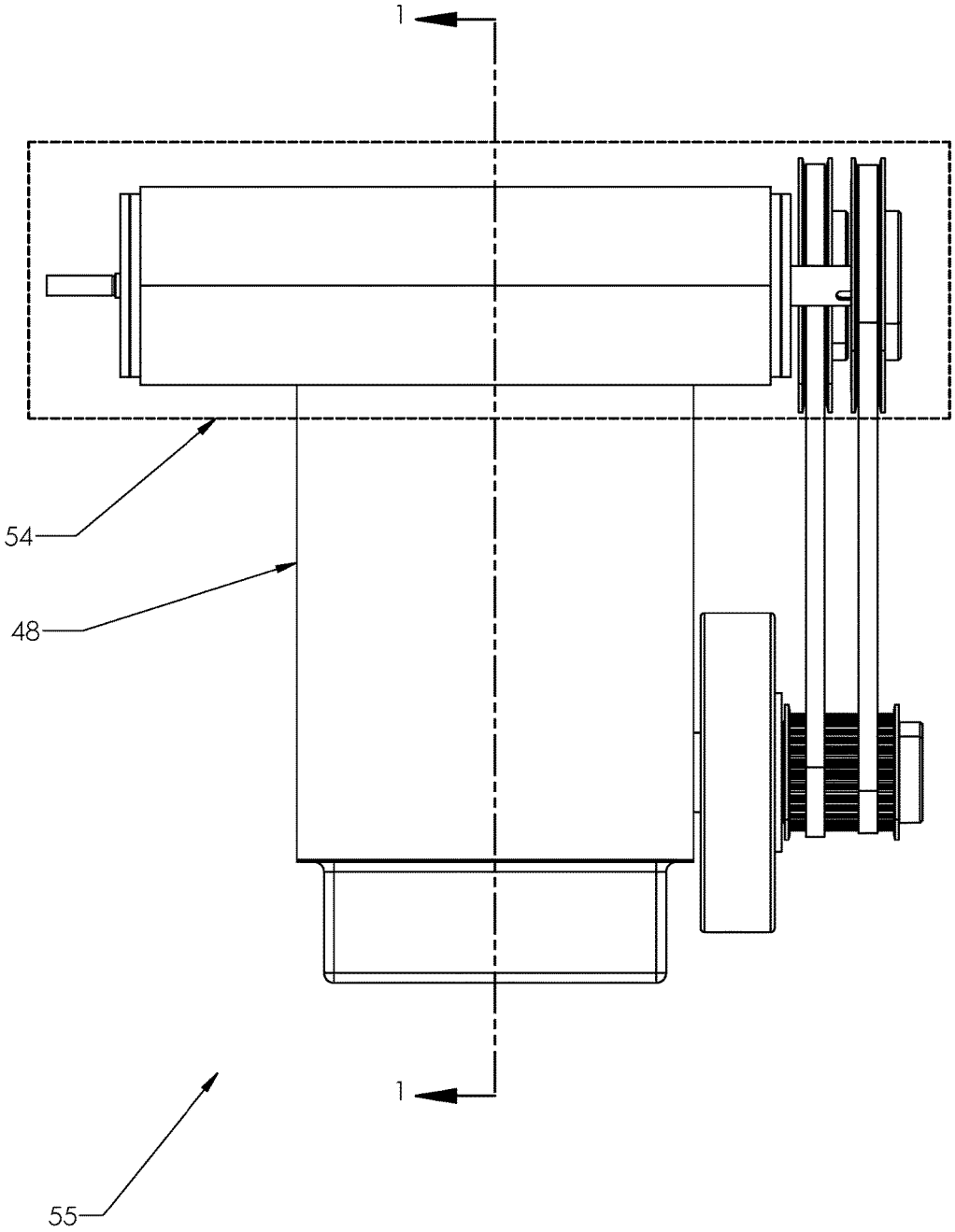
Figure 19:
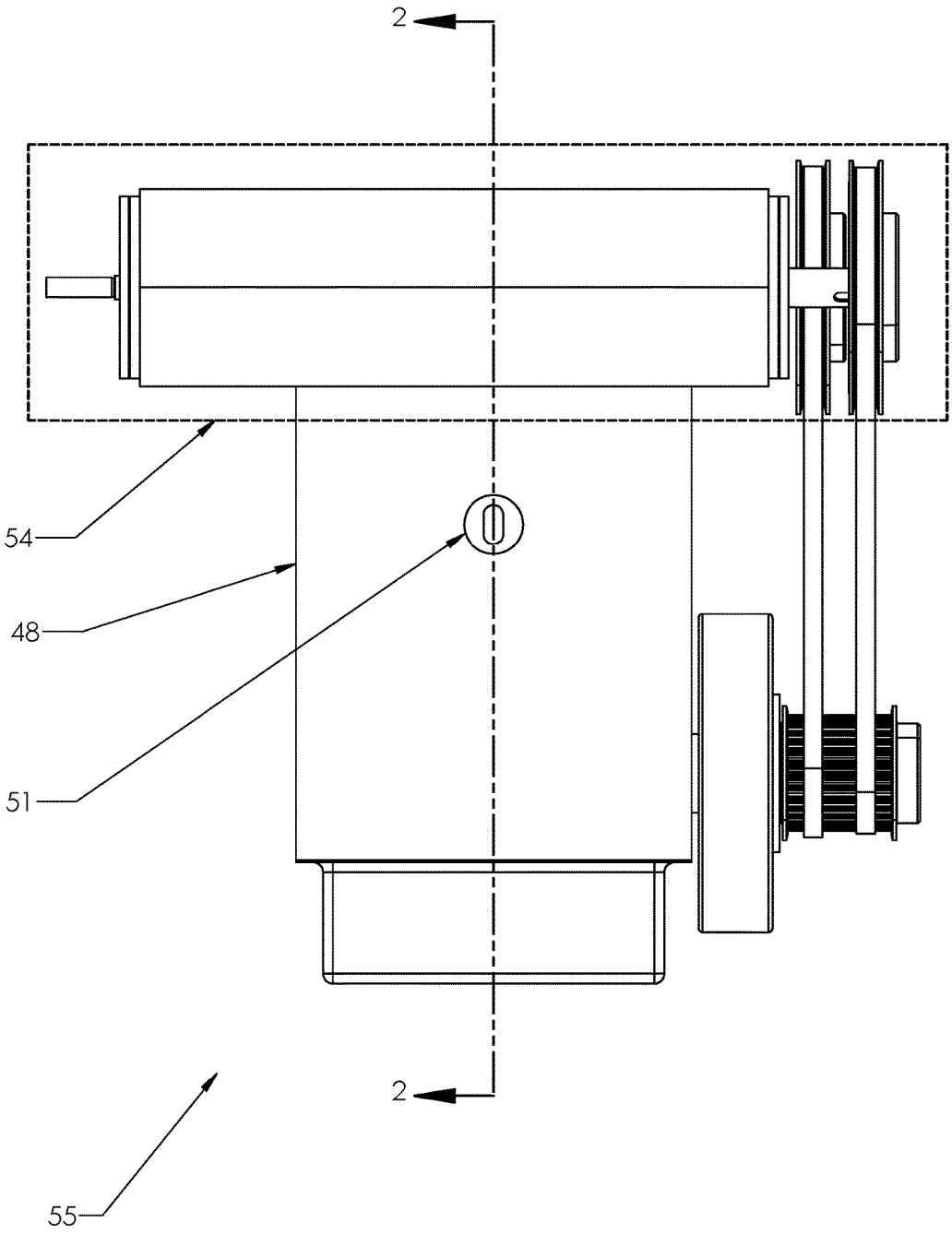
Figure 20:
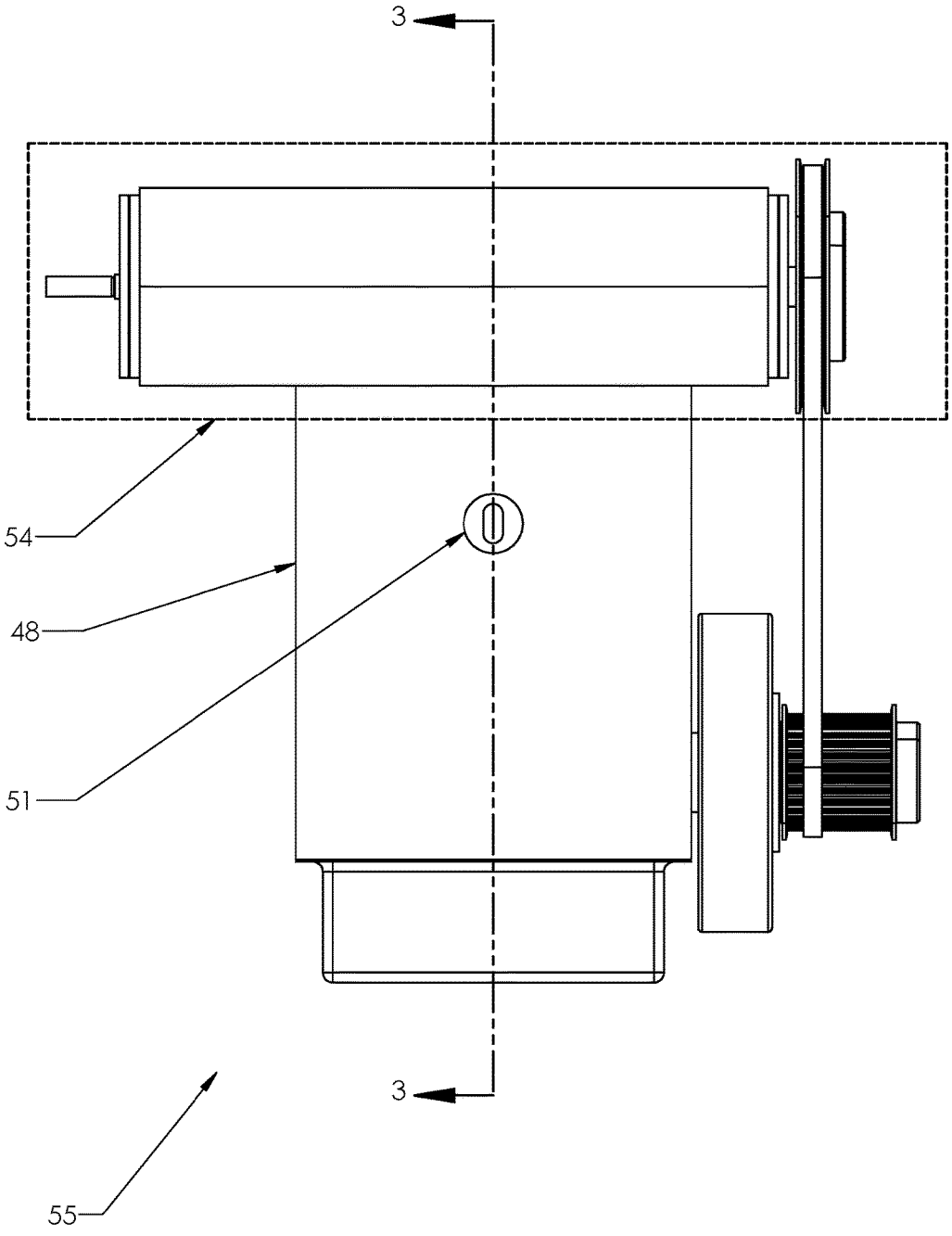
Figure 21:
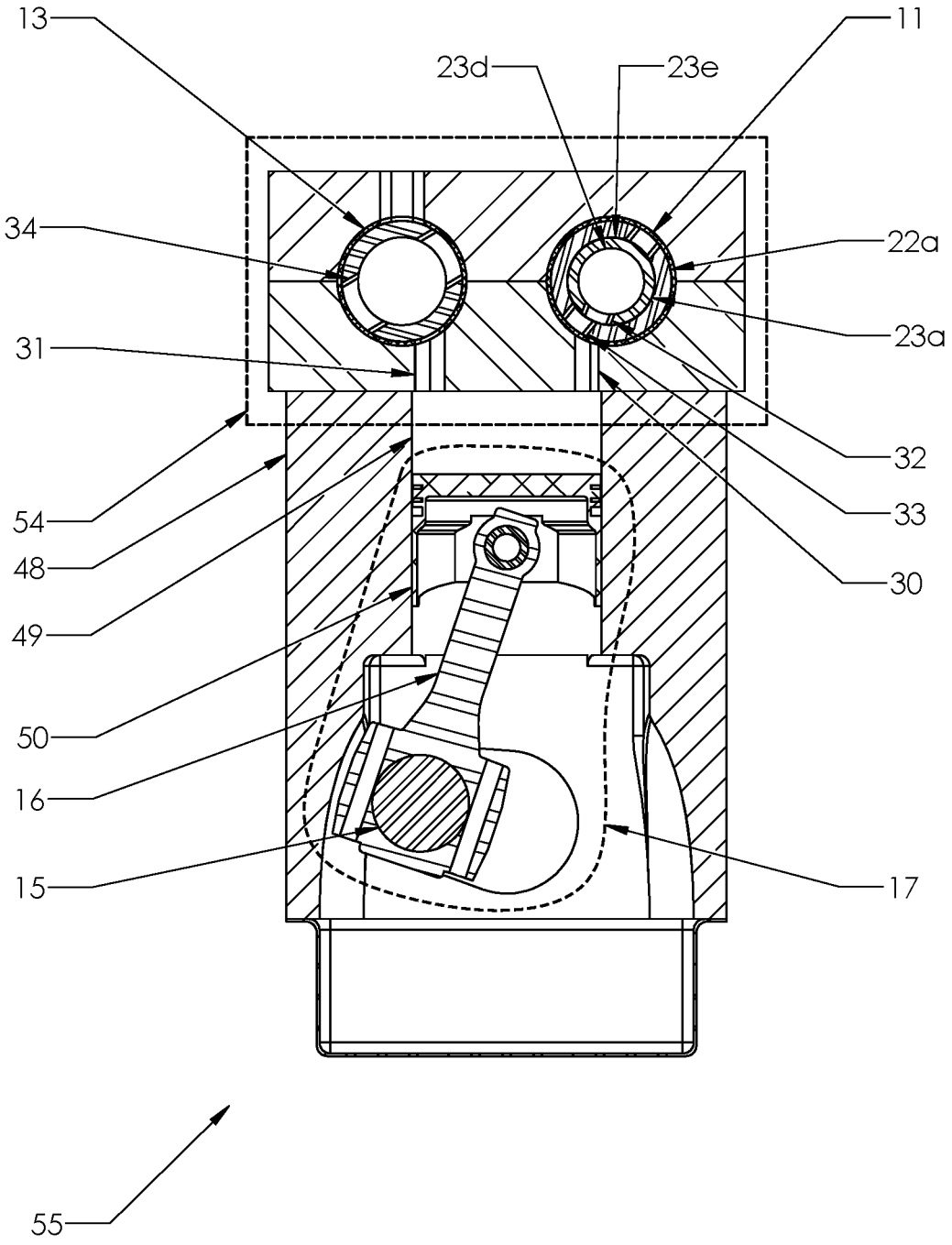
Figure 22:
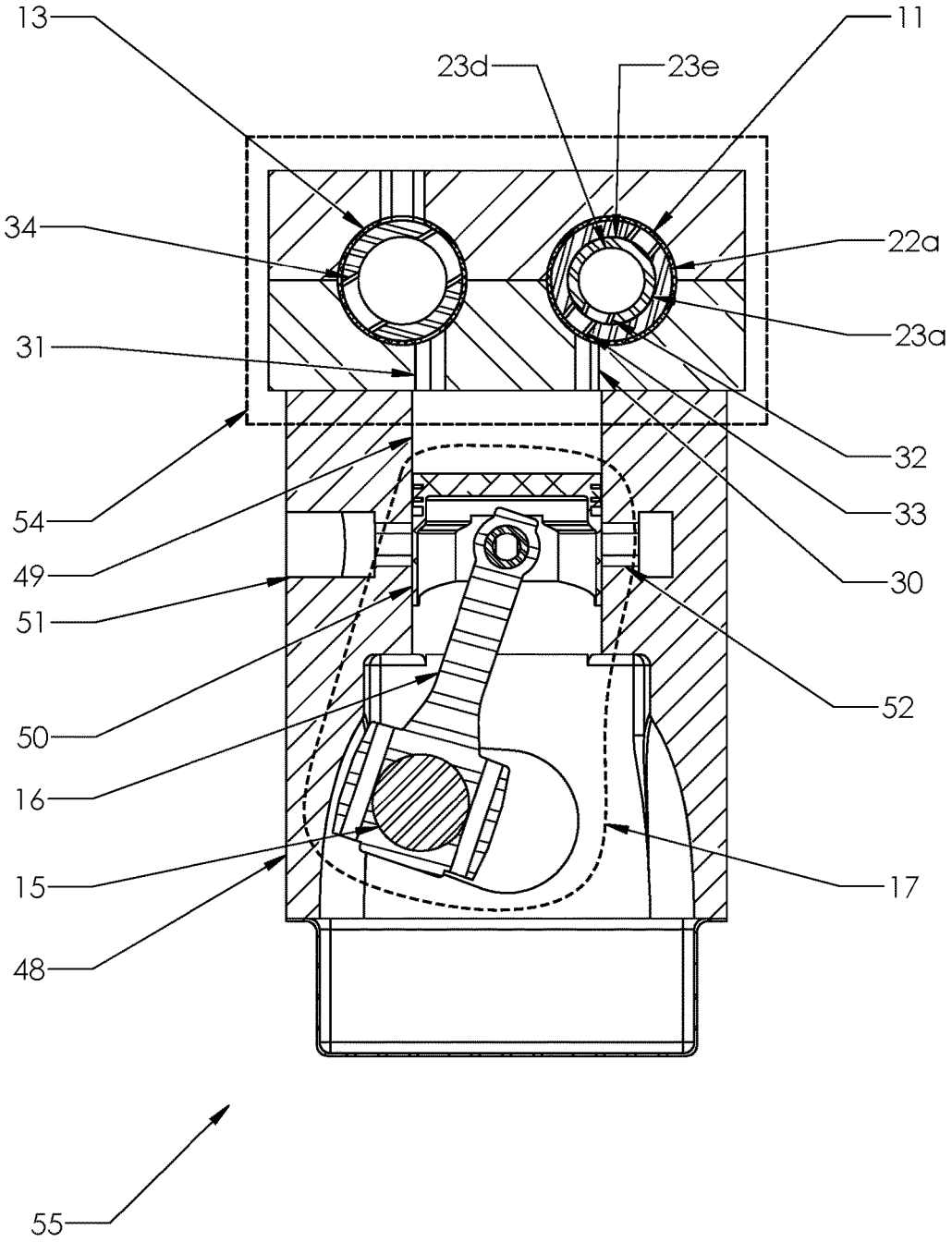
Figure 23:
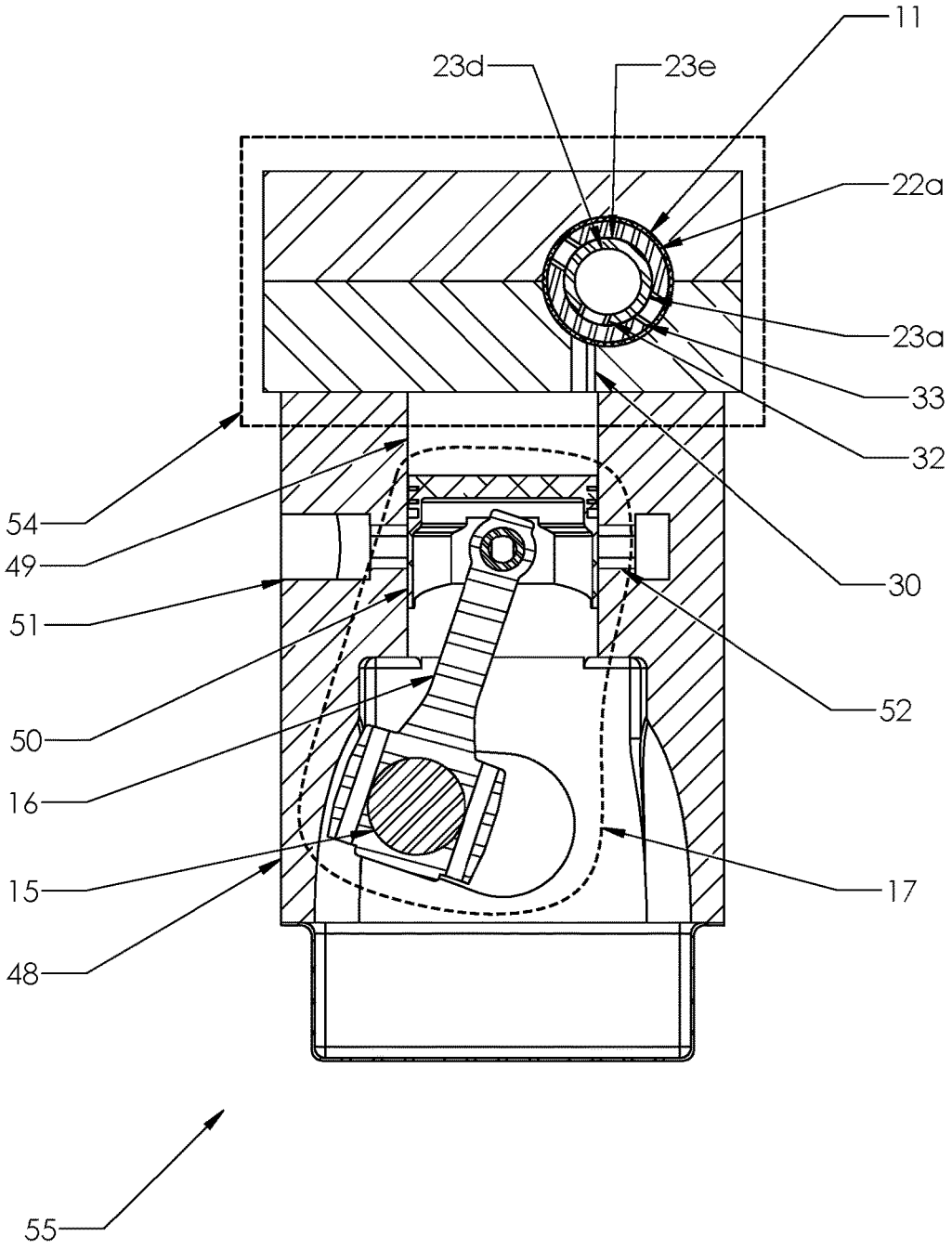
Figure 24:
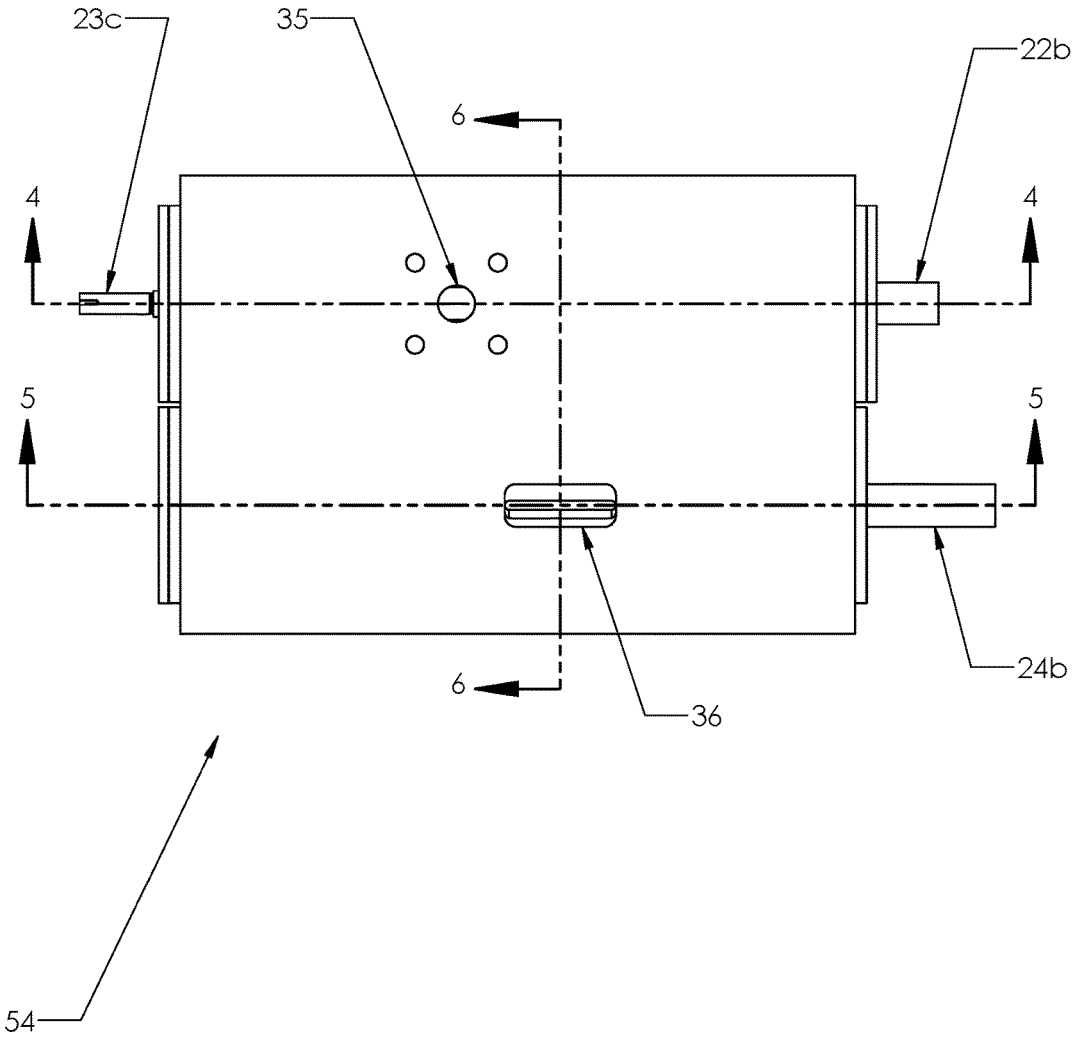
Figure 25:
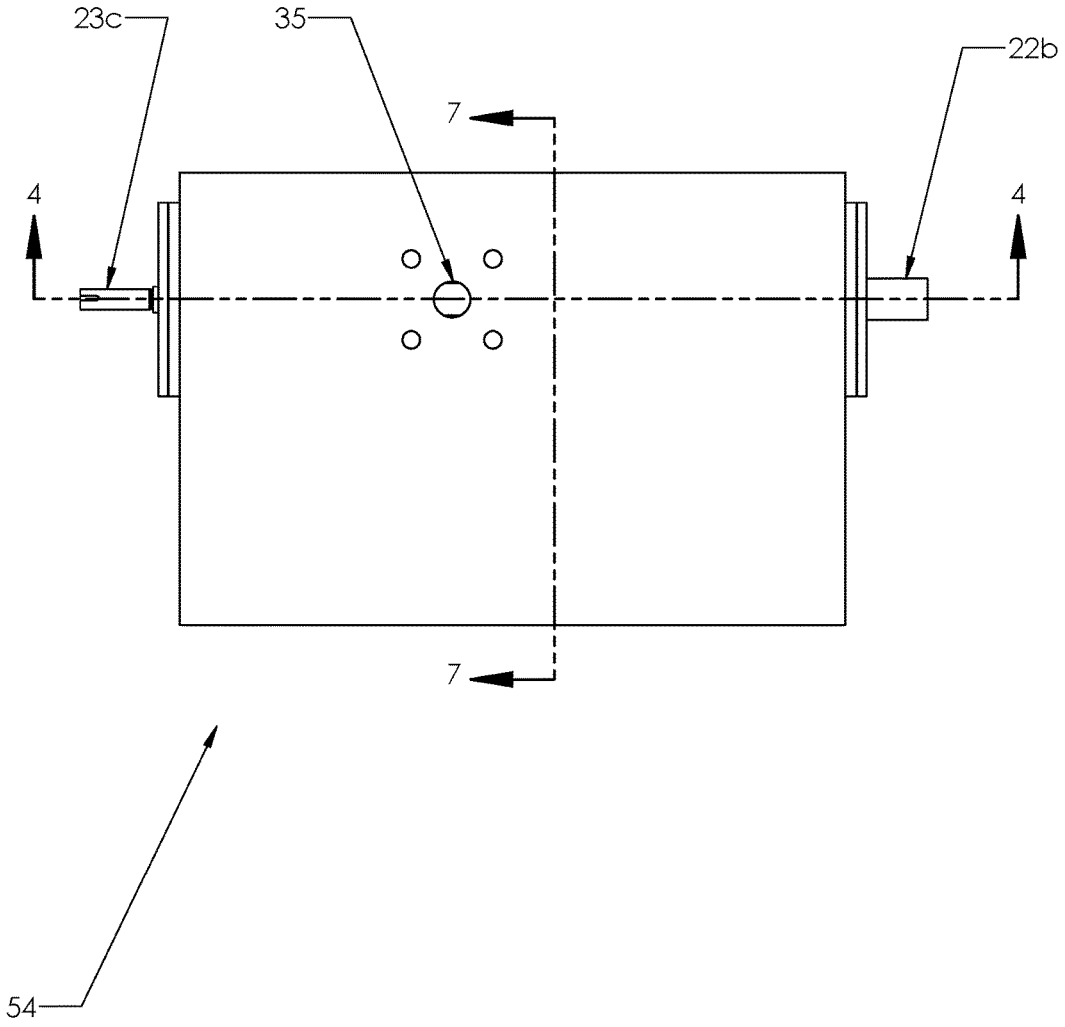
Figure 26:
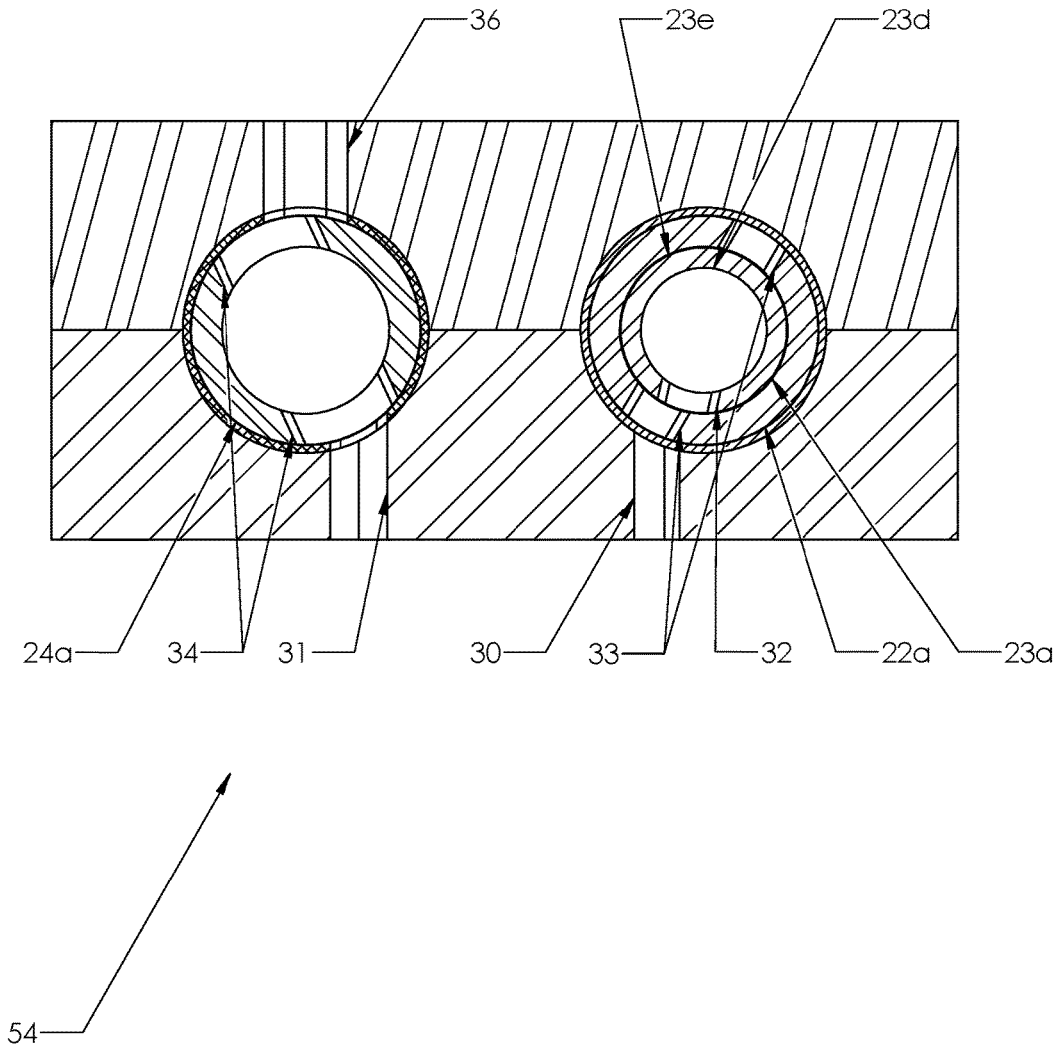
Figure 27:
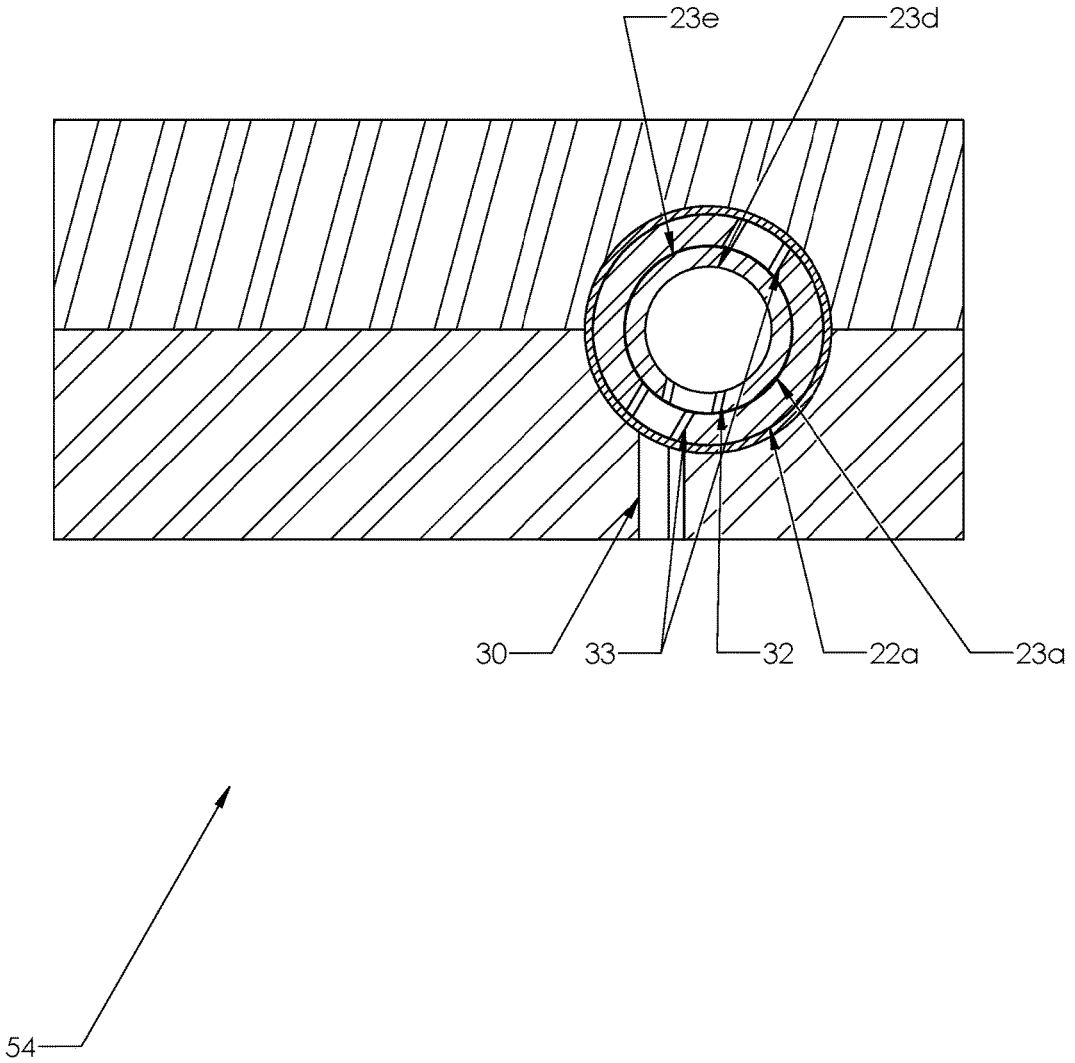

Having thus described the invention in general terms, reference will now be made to the accompanying drawings, which are not necessarily drawn to scale, and wherein:

FIG. 1 shows an exploded view of an intake rotary valve assembly according to some embodiments discussed herein;

FIG. 2 shows an exploded view of an exhaust rotary valve assembly according to some embodiments discussed herein;

FIG. 3 shows an isometric view of an intake valve assembly according to some embodiments discussed herein;

FIG. 4 shows an isometric view of an intake valve assembly according to some embodiments discussed herein;

FIG. 5 shows an isometric view of a throttle valve assembly according to some embodiments discussed herein;

FIG. 6 shows an isometric view of a throttle valve assembly according to some embodiments discussed herein;

FIG. 7 shows an end section view of an intake rotary valve assembly according to some embodiments discussed herein;

FIG. 8 shows a longitudinal cross section of an intake rotary valve assembly according to some embodiments discussed herein;

FIG. 9 shows a longitudinal cross section of an intake rotary valve assembly according to some embodiments discussed herein;

FIG. 10 shows an isometric view of an exhaust rotary valve assembly according to some embodiments discussed herein;

FIG. 11 shows an isometric view of an exhaust rotary valve assembly according to some embodiments discussed herein;

FIG. 12 shows an end section view of exhaust rotary valve assembly according to some embodiments discussed herein;

FIG. 13 shows a longitudinal cross section of an exhaust rotary valve assembly according to some embodiments discussed herein;

FIG. 14 shows a longitudinal cross section of an exhaust rotary valve assembly according to some embodiments discussed herein;

FIG. 15 shows an isometric view of a counter flow engine according to some embodiments discussed herein;

FIG. 16 shows an isometric view of a semi-uniflow engine according to some embodiments discussed herein;

FIG. 17 shows an isometric view of a uniflow engine according to some embodiments discussed herein;

FIG. 18 shows a side view of a counterflow engine according to some embodiments discussed herein;

FIG. 19 shows a side view of a semi-uniflow engine according to some embodiments discussed herein;

FIG. 20 shows a side view of a uniflow engine according to some embodiments discussed herein;

FIG. 21 shows a cross-sectional view of a counterflow engine according to some embodiments discussed herein;

FIG. 22 shows a cross-sectional view of a semi-uniflow engine according to some embodiments discussed herein;

FIG. 23 shows a cross-sectional view of a uniflow engine according to some embodiments discussed herein;

FIG. 24 shows a top view of a rotary valve assembly of a counterflow or semi-uniflow engine according to some embodiments discussed herein;

FIG. 25 shows a top view of a rotary valve assembly of a uniflow engine according to some embodiments discussed herein;

FIG. 26 shows a cross-sectional view of a rotary valve assembly of a counterflow or semi-uniflow engine according to some embodiments discussed herein; and FIG. 27 shows a cross-sectional view of a rotary valve assembly of a uniflow engine according to some embodiments discussed herein.

DETAILED DESCRIPTION

Exemplary embodiments of the present invention now will be described more fully hereinafter with reference to the accompanying drawings, in which some, but not all embodiments of the invention are shown. Indeed, the invention may be embodied in many different forms and should not be construed as limited to the exemplary embodiments set forth herein; rather, these embodiments are provided so that this disclosure will satisfy applicable legal requirements. Like reference numerals refer to like elements throughout.

Some embodiments detailed herein include a rotary valve assembly for use in thermal-fluid and expansion engines, including, for example, steam engines. As detailed herein, embodiments of the rotary valve assembly (e.g., rotary valve assembly 54 shown in FIG. 1-2, 7-9, 12-14, or 18-27) may control the flow of a working fluid (e.g., steam) under pressure into and/or out of an engine chamber to facilitate operation of a drive member (e.g., piston, rotor, etc.). The rotary valve assemblies may include one or more intake rotary valve assemblies and/or one or more exhaust rotary valve assemblies positioned in cylindrical bores of one or more valve housings. For example, some embodiments of the rotary valve assembly may be used in counter flow, semi-uniflow, and/or uniflow expansion engines.

The working fluid of the engine may be an organic and/or inorganic fluid, either naturally occurring or manmade. The working fluid may include, for example: Chlorofluorocarbon (CFC) (e.g. R-11, R-12); Hydrofluorocarbons (HFC) (e.g. R-134a, R-245fa); Hydrochlorofluorocarbon (HCFC) (e.g. R-22, R-123); Hydrocarbons (HC) (e.g. Butane, methane, pentane, propane, etc.); Perfluocarbon (PFC); Basic organic compounds (Carbon dioxide, etc.); Inorganic compounds (e.g. Ammonia); Elements (Hydrogen, etc.), or a combination thereof, amongst others. A preferred working liquid is steam.

The rotary valve assembly (e.g., rotary valve assembly 54 shown in FIG. 1-2, 7-9, 12-14, or 18-27) may be used with expansion engines including piston engines (e.g., uniflow, semi-uniflow, or counterflow engines), rotary engines, or other thermal-fluid expansion engines (e.g., engines 55 shown in FIGS. 15-23). The rotary valve assembly may be used on any size engine regardless of number of cylinders/chambers. Most commercial engines are piston type that have four, six, or eight cylinders where each cylinder operationally houses a piston. Although some embodiments described herein may show a single valve assembly or a single piston, the rotary valve assemblies and engines may be expanded to fit any engine type or configuration.

Referring to FIG. 1, embodiments of a rotary valve assembly 54 may include an intake valve housing 10. The intake valve housing 10 may be attached to a chamber housing, either integrally or separately mounted, as detailed herein. The intake valve housing 10 may be an integral part of a larger engine component (e.g., an engine block of engine 55 shown in FIGS. 15-23) or may be separately formed and connected.

The intake valve housing 10 may include a bore 11 that may receive an intake valve assembly 22. The bore 11 may be at least partially cylindrical and an outer surface of the main body (e.g., body 22*a* shown in FIG. 3) of the intake valve assembly 22 may be a complementary cylindrical shape to allow the intake valve assembly to rotate within the bore of the intake valve housing. A throttle valve assembly 23 may be positioned within the intake valve assembly 22. The intake valve assembly 22 may include a cylindrical bore, and an inner surface of the main body (e.g., body 22*a* shown in FIG. 3) of the intake valve assembly may be generally cylindrical. An outer surface of the main body (e.g., body 23*a* shown in FIG. 5) of the throttle valve assembly 23 may be a complementary cylindrical shape to allow relative rotation between the intake valve assembly 22 and the throttle valve assembly 23.

With continued reference to FIG. 1, an example intake/throttle valve assembly 25, which may include the intake valve assembly 22 and the throttle valve assembly 23, is shown assembled. As detailed herein, one or more valve bearing/seal assemblies 40 may support the intake/throttle valve assembly 25 along a longitudinal axis of the intake/throttle valve assembly, such that the intake valve assembly 22 and throttle valve assembly 23 may both be concentric with respect to each other and the intake valve housing bore 11. Said differently, referring to FIGS. 8-9, throttle valve assembly 23 may include a throttle valve body 23*a* which has an inside diameter 23*d* and outside diameter 23*e*. The intake rotary valve assembly 22 may include an intake valve body 22*a* which runs complimentary along the outside diameter 23*e* of the throttle valve body 23*a* and the intake rotary valve assembly cylindrical bore 11. The bearing/seal assemblies 40 may allow the intake valve assembly 22 and throttle valve assembly 23 to rotate within the bore 11 about the longitudinal axis. In some embodiments, the intake valve assembly may be positioned concentrically within the throttle valve assembly.

A retaining assembly 41 may engage an end (e.g., rear end 23*c* shown in FIG. 5) the throttle valve assembly 23 and one or more of the valve bearing/seal assemblies 40. In some embodiments, the retaining assembly may maintain and control the rotational position of the throttle valve assembly 23 to adjust the rate of flow of working fluid through the intake/throttle valve assembly 25.

With reference to FIG. 2, a rotary valve assembly 54 may additionally or alternatively include exhaust valve housing 12 and exhaust valve assembly 24. The exhaust valve housing 12 may be either integrally or separately attached to a chamber housing and/or the intake valve housing 10 to form an engine (e.g., engine 55 shown in FIGS. 15-23). The exhaust valve housing 12 may be an integral part of a larger engine component (e.g., an engine block of the engines 55) or may be separately formed and connected.

The exhaust valve housing 12 may include a bore 13 that may receive the exhaust valve assembly, 24. The bore 13 may be at least partially cylindrical and an outer surface of the main body (e.g., body 24*a* shown in FIG. 10) of the exhaust valve assembly 24 may be a complementary cylindrical shape to allow the exhaust valve assembly to rotate within the bore of the exhaust valve housing 12. One or more valve bearing/seal assemblies 40 may support the exhaust valve assembly 24 along a longitudinal axis of the exhaust valve assembly, such that the exhaust valve assembly may be concentric with respect to the exhaust valve housing bore 13. The bearing/seal assemblies 40 may allow the exhaust valve assembly 24 to rotate within the bore 13 about the longitudinal axis. A retaining assembly 41 may also engage the exhaust valve assembly and retain the exhaust valve assembly 24 within the bore 13. For example, the retaining assembly 41 may pull the exhaust valve assembly 24 or the throttle/intake valve assembly 25 rearward and maintain the valve assembly against the bearing to prevent axial movement. In some embodiments, the valve assemblies (e.g., exhaust valve assembly 24 or the throttle/intake valve assembly 25) may be allowed to expand forward as they heat up.

In some embodiments, the intake valve assembly 22 and/or the exhaust valve assembly 24 may be connected to an engine power shaft (e.g., as shown in FIGS. 15-17). The intake valve assembly 22 and exhaust valve assembly 24 may rotate at a speed directly related to engine power shaft speed. In some embodiments, the intake valve assembly 22 and/or the exhaust valve assembly 24 may rotate at one half the speed of the engine output. In some embodiments, the intake valve assembly 22 and/or the exhaust valve assembly 24 may rotate at 1/N the speed of the engine output, where "N" may be any positive integer (e.g., 1, 2, 3, 4, 5, 6, 7, 8, 9, 10, etc.). With reference to FIGS. 15-17, example engines 55 are shown having an output power shaft 15 connected to a front end 22*b* of the intake valve assembly 22 via an intake drive belt 46 and intake valve pulley 44. The output power shaft 15 may be connected to a front end 24*b* of the exhaust valve assembly 24 via an exhaust drive belt 47 and exhaust valve pulley 45. The rotation of the intake valve assembly 22 and exhaust valve assembly, 24, may be mechanically driven by the power shaft via any type of belt, pulley, chain, gear, or other drive mechanism. In some embodiments, the speed of the intake valve assembly 22 and the exhaust valve assembly 24 may be the same (e.g., the same gear ratio with respect to the output power shaft 15). In some embodiments, the intake valve assembly 22 and the exhaust valve assembly 24 may rotate at different speeds.

Referring to FIGS. 1, 3-9, 21-23, 26, and 27, operation of some embodiments of the intake valve/throttle valve assembly 25 will now be described more fully. In some embodiments, working fluid may be supplied to the intake valve assembly 10 through the working fluid inlet port 35 and the working fluid may fill annular volume of the bore 13 around the intake valve assembly 22. With reference to FIGS. 3-4, 8, and 9, the intake valve assembly 22 may include one or more working fluid intake inlet ports 37 radially located around a circumference of the intake body 22*a*. In some embodiments, the intake inlet ports 37 may be evenly distributed around the circumference of the body 22*a*, to radially balance the intake valve assembly 22.

In some embodiments, the intake valve assembly 22 may include at least one intake chamber port 33 per chamber of the engine. The number of intake chamber ports 33 per chamber may depend upon the rotational speed of the intake valve assembly 22 relative to the speed of the output power shaft (e.g., shaft 15 shown in FIGS. 15-17) of the engine. For example, if the intake valve assembly 22 operates at the same speed of the engine, the intake valve assembly may include one intake chamber port 33 per chamber (e.g., such that the intake chamber port 33 aligns with the outlet 30 once per revolution). If the intake valve assembly 22 operates at one half the speed of the output power shaft (e.g., shaft 15 shown in FIGS. 15-17), the intake valve assembly may include two intake chamber ports 33 per chamber (e.g., such that the intake chamber ports 33 align with the outlet 30 twice per revolution). In embodiments having more than one intake chamber port 33, the intake chamber ports may be evenly distributed relative to the circumference of the intake valve body 22*a* to radially balance the intake valve assembly 22. In some embodiments, valve speeds slower than the engine speed (e.g., half-speed, quarter-speed, etc.) may produce a naturally balanced valve assembly while allowing higher engine speeds.

With reference to FIGS. 5, 6, 8, and 9, the throttle valve assembly 23 may include throttle inlet ports 38, radially located around the circumference of the throttle valve body 23*a*. Additionally, the throttle valve assembly 23 may include at least one throttle chamber port 32. In operation, the throttle valve assembly 23 may remain generally stationary while the intake valve assembly 22 rotates with the engine as described above. The generally stationary rotational position of the throttle valve assembly 22 may be adjusted to vary the throughput of the rotary valve assembly 54, as discussed below. A mechanical actuator (not shown), such as a pneumatic motor or stepper motor may engage the rear end 23*c* of the throttle valve assembly 22 to control the rotational position of the throttle valve assembly 22. As the intake valve assembly 22 rotates, the intake inlet ports 37 may align with the throttle inlet ports 38 and the working fluid inlet port 35 of the valve assembly 10. As the ports align, the working fluid may flow into the interior of the throttle valve assembly 23. In some embodiments, one intake valve assembly 22 and/or one throttle valve assembly 23 may be used for multiple chambers, and chamber ports for the respective chambers may be spaced along the longitudinal direction of the assemblies. In some embodiments, separate valve assemblies may be used for each chamber.

In some embodiments, the intake inlet ports 37 may be spaced from the intake chamber ports 33 along the longitudinal axis, such that the intake inlet ports 37 may not align with the intake housing outlet chamber port 30 and the intake chamber ports 33 may not align with the working fluid inlet port 35. Similarly, the throttle inlet ports 38 may be spaced from the throttle chamber ports 32 along the longitudinal axis, such that the throttle inlet ports 38 may not align with the intake housing outlet chamber port 30 and the throttle chamber ports 32 may not align with the working fluid inlet port 35. In some embodiments, the intake inlet ports 37 may at least partially overlap with the throttle inlet ports 38 and the working fluid inlet port 35 relative to the longitudinal axis, and the intake chamber ports 33 may at least partially overlap the throttle chamber ports 32 and the intake housing outlet chamber port 30 relative to the longitudinal axis.

Referring to FIGS. 7, 21-23, 26, and 27, the intake valve body 22*a* may rotate relative to the rotary valve assembly 54 and the throttle valve assembly 23 until the intake chamber port 33 aligns with the throttle chamber port 32 and the housing outlet chamber port 30 resulting in the working fluid flowing through the housing outlet chamber port 30 and into the working chamber (e.g., cylinder 49) of the engine 54. In some embodiments, the intake housing outlet chamber port 30 and/or an exhaust housing inlet chamber port 31 may terminate directly within the chamber (e.g., cylinder 49) of the engine 54. The throttle valve body 23*a* may be rotationally modulated (e.g., using the mechanical actuator described above) in order to vary the timing and duration of the alignment of all three ports. The throttle valve assembly 23 may be adjusted angularly about the longitudinal axis by rotating the throttle valve assembly 23 rear end 23*c*, which may result in an adjustment of the duration of communication between the interior of the throttle valve body 23*a* and the cylinder head intake port 30 (e.g., due to the narrower overlap between each of the three ports 30, 32, 33) resulting in control of admission cutoff. The control of this admission cutoff may be used to control engine speed and/or power output. In some embodiments, intake inlet port 37 and intake chamber port 33 may be the same port. Similarly, in some embodiments throttle inlet port 38 and throttle chamber port 32 may be the same port. In some embodiments, one exhaust valve assembly 24 may be used for multiple chambers, and chamber ports for the respective chambers may be spaced along the longitudinal direction of the assemblies. In some embodiments, separate valve assemblies may be used for each chamber.

With reference to FIGS. 1-6, in some embodiments, one of the intake inlet ports 37, one of the throttle inlet ports 38, and the working fluid inlet port 35 may align substantially simultaneous with the alignment of one of the intake chamber ports 33, one of the throttle chamber ports 32, and the intake chamber outlet port 30. In some embodiments, the inlet ports 37, 38, 35 may align at a different time than the chamber ports 32, 33, 30. In such embodiments, the interior of the throttle valve assembly 23 may act as a reservoir for the working fluid. Similarly, in some embodiments, one exhaust port 34 and the exhaust working fluid outlet port 36 may align substantially simultaneous with the alignment of another of the exhaust ports 34 and the exhaust housing chamber inlet port 31. In some embodiments, the exhaust outlet ports 34, 36 may align at a different time than the exhaust inlet ports 34, 31, including in "full-speed" embodiments of the exhaust valve assembly 24 in which only one exhaust port 34 is used.

In some embodiments, the intake assembly 22 may include a greater number of intake inlet ports 37 than intake chamber ports 33. In such embodiments, the intake chamber ports 33 may align with the inlet 30 of the intake valve housing 10 at predetermined intervals based on the engine timing, as discussed herein, and the intake inlet ports 37 may communicate with the working fluid inlet 35 one or more times per engine cycle to receive the working fluid. Similarly, the throttle assembly 23 may include a greater number of throttle inlet ports 38 than throttle chamber ports 32.

In some embodiments, the intake assembly 22 may include one or more times (e.g., one, two, three, four, five, six, etc. times) the number of intake chamber ports 33 as throttle chamber ports 32 in the throttle assembly 23. In some embodiments, as discussed herein, the throttle assembly 23 may be generally stationary during operation and may be slightly adjusted to control cutoff of the rotary valve assemblies 54. In such embodiments, the throttle assembly 23 may include one throttle chamber port 32.

In reference to FIGS. 2, 10, and 11, the exhaust valve assembly 24 may include at least one exhaust port 34 per working chamber of the engine. The number of exhaust ports 34 per chamber may depend upon the rotational speed of the exhaust valve assembly 24 relative to the speed of the output power shaft (e.g., shaft 15 shown in FIGS. 15-17) of the engine. For example, if the exhaust valve assembly 24 operates at the same speed of the engine, the exhaust valve assembly may include one exhaust port 34 per chamber. If the exhaust valve assembly 24 operates at one half the speed of the output power shaft (e.g., shaft 15 shown in FIGS. 15-17), the exhaust valve assembly may include two exhaust ports 34 per chamber of the engine. In embodiments having more than one exhaust port 34, the exhaust chamber ports may be evenly distributed relative to the circumference of the exhaust valve body 24*a* to radially balance the exhaust valve assembly 24. In some embodiments, valve speeds slower than the engine speed (e.g., half-speed, quarter-speed, etc.) may produce a naturally balanced valve assembly.

In some multi-chamber embodiments detailed herein, the working fluid in the exhaust and intake assemblies may travel axially between the ports of different chambers (e.g., to exhaust working fluid from the valve or intake working fluid to the valve when one or more of the ports are closed). In some embodiments, dedicated exhaust outlet ports may be provided to communicate the exhaust valve assembly 24 with the exhaust working fluid outlet 30 more frequently, as shown with respect to the intake working fluid ports 37 and throttle working fluid ports 38.

Referring to FIGS. 12, 21, 22, and 26, the exhaust valve body 24*a* may rotate until the exhaust chamber port 34 aligns with the exhaust housing inlet chamber port 31. When the ports are aligned, the working fluid may flow out of the chamber of the engine 55 and into the interior of the exhaust valve assembly 24 through the exhaust housing inlet chamber port 31. The working fluid may then exit the exhaust valve assembly 24 through the exhaust port 34 and flow into the exhaust valve housing 12. The working fluid may exit the exhaust valve housing 12 through exhaust working fluid port 36. In some embodiments, the working fluid may exit the exhaust valve through a dedicated exhaust working fluid port instead of through exhaust port 34.

In some embodiments, the ports (e.g., any of ports 30-38) may be generally rectangularly shaped. As detailed herein, the term "generally rectangular" may include four sides arranged substantially perpendicularly and may include rectangles with rounded corners and/or tapered wall sections. In such embodiments, the rectangular shape of the ports may include a long dimension and a short dimension, in which the long dimension may be longer than the short dimension and oriented parallel to the longitudinal axis and the short dimension may be oriented circumferentially for ports disposed on one of the valve assemblies. Rectangularly shaped ports may allow for efficient opening and closing of the valves, and the longer edge in the long dimension may be perpendicular to the direction of rotation of the surface of the valves, such that the straight leading longer edges and trailing longer edges of the valves may allow for precise, quick, and efficient opening and closing during rotation. In some embodiments rectangularly shaped ports may also improve the cost efficiency of manufacturing the valves.

Referring to FIGS. 3-6, 8, and 9, the intake valve assembly 22 front end 22*b* may support the front of the intake valve body 22*a*, and the intake valve assembly 22 rear end 22*c* may support the rear of the intake valve body 22*a*. These components may be connected together by known fasteners such as bolts, screws, cross pins, welding, and other connectors known in the art. The intake valve assembly front end 22*b* and rear end 22*c* may be supported by one or more bearings 27 operably mounted to the intake valve housing 10. In some embodiments, the bearings 27 may aligned concentrically with the intake rotary valve assembly 22 and the intake valve housing cylindrical bore 11 along the longitudinal axis to allow the intake rotary valve/throttle assembly 25 to rotate within the bore. The valve bearings 27 may provide support to the rotary valve/throttle assembly 25 in the radial and/or axial directions. With reference to FIG. 9, in some embodiments, a bushing may be operably mounted to the intake valve housing 10, and the bushing may be concentrically aligned on the longitudinal axis with the intake valve assembly 22 and throttle valve assembly 23. In some embodiments, the bushing may support the rear end 23*c* of the throttle valve assembly 23. The bushing may be used instead of or in addition to a throttle bearing 29 to support and maintain the throttle valve assembly in a generally stationary position, which may be adjustable, while the intake valve assembly 22 rotates with the engine.

In some embodiments, seals 26 (e.g., rotary lip seals) may be disposed between the working fluid inlet 35 and the bearings 27 to protect the bearings 27 from the working fluid. FIG. 8 illustrates the optional use of multiple valve bearings 27 for reduced deflection of the intake valve/throttle assembly 25 due to additional moment reaction in the valve assemblies. For example, multiple bearings 27 may be positioned on one or both ends 22*b*, 22*c* of the intake valve assembly 22 to stabilize the valve 22 in the radial and/or axial directions.

In some embodiments, leakage vents 39 may allow working fluid that leaks past the seals to escape and not compromise the integrity of the valve bearings 27. In some further embodiments, a vacuum may be applied at the vents 39 between one or more of the seals 26 and one or more of the bearings 27 to improve the longevity of the bearings. The vacuum may be applied by pump or similar device (not shown), which may be powered by the engine 55 or by an external source. The valve bearings 27 may provide both radial and axial support. A retainer 41 is used to control thrust. In some embodiments, the retainer 41 may be a bearing nut. In some embodiments, the retainer 41 may be c-clips, pins or other retaining mechanisms.

The intake rotary valve assembly 22 may accommodate and receive the throttle valve assembly 23 therein. The throttle valve assembly 23 front end 23*b* may supported by at least one throttle bearing 29 positioned at the intake rotary valve assembly 22 front end 22*b* between at least a portion of the intake rotary valve assembly 22 and the throttle valve assembly 23. Similarly, the rear end 23*c* of the throttle valve assembly 23 may be supported by at least one throttle bearing 29 positioned at the intake valve assembly rear end 22*c* between at least a portion of the intake rotary valve assembly 22 and the throttle valve assembly 23. Multiple throttle bearings 29 may be positioned at each end to improve moment reaction and reduced deflection of throttle valve assembly 23. The throttle bearings 29 may serve as support in the radial and/or axial direction. In some embodiments, seals 28 (e.g., rotary lip seals) may prevent working fluid leakage and protects the throttle bearings 29 from the working fluid. The vents 39 communicate to ports in the throttle valve assembly in order to evacuate working fluid that leaks past the seals 28. As detailed above, a vacuum may also be applied at the vents between one or more of the seals 28 and one or more of the throttle bearings 29 to reduce damage to and improve the longevity of the bearings. In some embodiments, the vents 39 may simultaneously fluidly connect a space between the valve bearings 27 and seals 26 and between the throttle bearings 29 and the seals 28, and the vents 39, via a pump or other mechanism, may apply a vacuum therebetween.

Referring to FIGS. 10, 11, 13, and 14, the exhaust valve assembly front end 24*b* may support the front of the exhaust valve body 24*a*, and the exhaust valve assembly rear end 24*c* may support the rear of the exhaust valve body 24*a*. These components may be operably connected, such as by bolts, screws, cross pins, welding, or other attachment mechanisms known in the art. The exhaust valve assembly front end 24*b* and rear end 24*c* may be supported within the cylindrical bore 13 by at least one bearing 27 mounted to the exhaust valve housing 12, such that the exhaust valve assembly 24 may be concentrically disposed within the bore and may be able to rotate about the longitudinal axis. The bearings 27 may support the exhaust valve assembly 24 in the radial and/or axial direction.

In some embodiments, seals 26 (e.g., rotary lip seals) may be disposed between the working fluid exhaust 36 and the bearings 27 to protect the bearings from the working fluid. With reference to FIG. 13, an example exhaust valve assembly 24 is shown having multiple valve bearings 27 for reduced deflection of the exhaust valve assembly 24 cause by the additional moment reaction of the valve assemblies.

In some embodiments, leakage vents 39 may allow working fluid that leaks past the seals 26 to escape and not compromise the integrity of the valve bearings 27. In some further embodiments the vents 39 may be vented to vacuum, such that a vacuum is applied between one or more of the seals 26 and one or more of the bearings 27. The vacuum may be applied by pump or similar device (not shown), or may be applied by negative pressure in the engine which may be created by the drive elements (e.g., piston 50) in the chamber (e.g., cylinder 49). The valve bearings 27 may provide both radial and axial support to the exhaust valve assembly 24. The retainer 41 may be used to control and support the axial direction of the exhaust valve assembly. In some embodiments, the retainer 41 may be a bearing nut. In some embodiments, the retainer may include c-clips, pins or other retaining mechanisms.

As detailed above, the rotary valve assemblies 54 discussed herein may be attached to an expansion-driven engine. With reference to FIGS. 15-27, in some embodiments, the rotary valve assembly may include one or more intake valve housings 10, which may include one or more intake valve assemblies 22 and/or throttle assemblies 23, and one or more exhaust valve housings 12, which may include one or more exhaust valve assemblies 24. The rotary valve assemblies may receive working fluid (e.g., steam) under pressure from a boiler, compressor, and/or other source at the working fluid inlet port 35 for driving the engine, which may convert the pressure of the working fluid into mechanical work. As detailed herein, the rotary valve assemblies, including one or more of the intake valve housings 10 and/or exhaust valve housings 12 may be attached, either integrally or by a fastening device such as a bolt, screw, adhesive, welding, or other known attachment means, to an engine chamber housing 48. In some embodiments the rotary valve assemblies 54 may be rigidly attached directly and/or integrally to the engine chamber housing 48, and in some embodiments, a gasket, seal, or other device may be positioned between the rotary valve assemblies 54 and the engine chamber housing 48. However, in either event, the rotary valve assemblies 54 and chamber housing 48 may be said to be rigidly attached.

For example, some embodiments of the engine may include a linear piston-driven engine as shown in FIGS. 21-23. In some embodiments, the engine may include any desired number of cylinders, including but not limited to one, two, four, six, or eight cylinders. Referring to FIGS. 21-23, for example purposes, the engine 55 is shown having a single cylinder 49. In some embodiments, the working fluid (e.g., steam) is distributed to the engine at the working fluid inlet port 35, and may be distributed through the engine 55 by the rotary valve assemblies 54. With reference to FIGS. 17, 20, and 23, a uniflow engine receives working fluid at the working fluid inlet port 35 and applies the working fluid to the engine chamber (e.g., cylinder 49) to actuate the drive member (e.g., piston 50). With reference to FIG. 23, when the piston 50 passes below the cylinder wall exhaust port 52, the working fluid may enter the cylinder wall exhaust port 52 and exit the engine through exhaust ports 51.

With reference to FIGS. 16, 19, and 22, an example of a semi-uniflow engine is shown. A semi-uniflow engine may receive working fluid at the working fluid inlet port 35 and may apply the working fluid to the engine chamber (e.g., cylinder 49) to actuate the drive member (e.g., piston 50). The semi-uniflow engine may then exhaust working fluid through at least two exhaust ports 36, 39. With reference to FIG. 22, when the piston 50 passes below the cylinder wall exhaust port 52, the working fluid may enter the cylinder wall exhaust port 52 and exit the engine through exhaust ports 51. The semi-uniflow engine may exhaust working fluid remaining in the cylinder through exhaust port 36 via the exhaust valve assembly 24 as detailed above.

With reference to FIGS. 15, 18, and 21, an example of a counterflow engine is shown. A counterflow engine may receive working fluid at the working fluid inlet port 35 and may apply the working fluid to the engine chamber (e.g., cylinder 49) to actuate the drive member (e.g., piston 50). The counterflow engine may then exhaust working fluid through the exhaust outlet 36 using an exhaust assembly 24.

In some embodiments, the engine 55 may open the respective exhaust systems (e.g., exhaust ports 34 may communicate with exhaust housing chamber inlet port 31 and/or a portion of the chamber 49 holding the working fluid may be exposed to outlets 51) with respect to the chamber (e.g., cylinder 49) to allow the working fluid to exit the chamber at approximately the maximum volume of the chamber (e.g., near or at the maximum downstroke of the piston 50 in the embodiment of FIGS. 21-23), and the engine may close the respective exhaust systems at some point before the minimum volume of the chamber (e.g., the maximum upstroke of the piston 50 in the embodiments of FIGS. 21-23). In some embodiments, the engine may open the intake system (e.g., intake valve assembly 22 and throttle valve assembly 23) with respect to the chamber 49 to allow the working fluid to enter the chamber at approximately the minimum volume of the chamber (e.g., the maximum upstroke of the piston 50 in the embodiments of FIGS. 21-23), and the engine may close the intake system at a throttle valve controlled point, which may be before the maximum volume of the chamber (e.g., near or at the maximum downstroke of the piston 50 in the embodiment of FIGS. 21-23).

Similarly, a rotary valve assembly 54 including an intake/throttle assembly 25 (e.g., including intake assembly 22 and throttle assembly 23) and/or an exhaust assembly 24 may be either integrally or separately attached to a rotary engine.

In some embodiments, whether a counterflow, semi-uniflow, uniflow, or rotary type engine, the exhaust from exhaust port (e.g., exhaust ports 36, 39) may be fed into the working fluid inlet port 35 of another engine or to the working fluid inlet port 35 of another cylinder of a multiple cylinder engine. In some embodiments, working fluid may be simultaneously fed into two or more engines and/or cylinders in parallel. Any number of cylinders and/or engines may be connected and combined in either series or parallel as described herein.

With reference to FIGS. 15-20 a belt drive system may be used in the engines to transmit mechanical energy throughout the system. As detailed above, the intake rotary valve assembly 22 and/or the exhaust rotary valve assembly 24 may be driven by at least one main output power shaft 15. The power shaft 15 in piston-operated embodiments may be a crankshaft or similar mechanism that may convert reciprocating motion into rotational motion. In such embodiments, the linear motion of a reciprocating piston 50 may be converted to rotational movement at the main power shaft 15 by a crank-slider mechanism 17 or other similar mechanism. The crank-slider mechanism 17 is comprised of at least one connecting rod 16 transmitting force between the main power shaft 15 and the reciprocating piston 50.

Power from the output power shaft 15 may be transmitted to the intake rotary valve assembly 22 and/or the exhaust rotary valve assembly 24 via corresponding intake drive belts 46 and/or exhaust drive belts 47, respectively. A primary drive pulley 43 may be operationally attached at an end of the output power shaft 43 to receive the intake drive belts 46 and/or exhaust drive belts 47. An intake valve pulley 44 may be operationally attached at the front end **22*b* of the intake rotary valve assembly 22, and an exhaust valve pulley 45 may be operationally attached at the front end 24*b* of the exhaust rotary valve assembly 24, such that the intake valve pulley 44 may receive torque from the intake drive belt 46 and the exhaust valve pulley 45 may receive torque from the exhaust drive belt 47**. In some embodiments, a chain, gear, hydraulic or electric motor, or other similar system may be used to transmit torque to the rotary valve assemblies.

Referring to FIGS. 15-23, the rotary valve assembly 54 may be either integrally or separately operationally attached to a chamber housing 48 (e.g., a cylinder block). The chamber housing 48 may include at least one chamber (e.g., at least one cylinder 49) which is comprised of at least one drive element (e.g., reciprocating piston 50). For semi-uniflow and uniflow engines, the chamber (e.g., cylinder 49) includes ports 52 in the wall.

Many modifications and other embodiments of the inventions set forth herein will come to mind to one skilled in the art to which these embodiments of the invention pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the appended claims. While some drawings and description may omit features described elsewhere for simplicity of explanation, it is understood that these features may nonetheless be present in any of the embodiments in any combination or configuration, as detailed above. Although specific terms are employed herein, they are used in a generic and descriptive sense only and not for purposes of limitation.

The invention claimed is:

1. A rotary valve assembly comprising:

a valve housing defining a cylindrical bore, an inlet, and an outlet;

an intake assembly configured to be at least partially received within the cylindrical bore of the valve housing, wherein the intake assembly comprises an intake body defining a cylindrical bore and having at least one intake inlet port and at least one intake chamber port; and a throttle assembly configured to be at least partially received within the cylindrical bore of the intake assembly, wherein the throttle assembly comprises a throttle body defining at least one throttle inlet port and at least one throttle chamber port;

wherein the throttle assembly and the intake assembly are concentric with respect to a longitudinal axis, wherein the throttle assembly and the intake assembly are configured to rotate independently of one another about the longitudinal axis, wherein the at least one intake chamber port and the at least one throttle chamber port at least partially overlap in a longitudinal direction, wherein the at least one intake inlet port and the at least one throttle inlet port at least partially overlap in the longitudinal direction, wherein, during operation of the rotary valve assembly, the valve housing is configured to permit fluid to enter the cylindrical bore of the valve housing via the inlet, the intake assembly is configured to rotate to permit the fluid to flow through the at least one intake inlet port and the at least one throttle inlet port into the throttle body, and the intake assembly is configured to permit the fluid to flow to the outlet from the throttle body through the at least one throttle chamber port and the at least one intake chamber port, and wherein the at least one intake chamber port comprises a greater number of ports than the at least one throttle chamber port.

2. The rotary valve assembly of claim 1, wherein the at least one intake chamber port comprises at least two intake chamber ports spaced symmetrically about a circumference of the intake body.

3. The rotary valve assembly of claim 2, wherein the at least one throttle chamber port comprises one throttle chamber port.

4. The rotary valve assembly of claim 1, wherein the at least one intake chamber port is spaced from the at least one intake inlet port in the longitudinal direction.

5. The rotary valve assembly of claim 1, further comprising at least one throttle bearing between the intake body and the throttle body, and at least one seal between the at least one throttle bearing and at least one of the at least one intake inlet port, the at least one throttle inlet port, the at least one intake chamber port, or the at least one throttle chamber port.

6. The rotary valve assembly of claim 5, further comprising vents disposed between the at least one throttle bearing and the at least one seal, wherein the vents are configured to apply a vacuum between the at least one throttle bearing and the at least one seal.

7. The rotary valve assembly of claim 1, further comprising a first pair of bearings between the bore of the valve housing and the intake assembly at a first end of the intake assembly, and a second pair of bearings between the bore of the valve housing and the intake assembly at a second end of the intake assembly.

8. The rotary valve assembly of claim 7, further comprising at least one seal between the at least one of the first pair of bearings or the second pair of bearings and at least one of the at least one intake inlet port, the at least one throttle inlet port, the at least one intake chamber port, or the at least one throttle chamber port, the rotary valve assembly further comprising vents disposed between the at least one of the first pair of bearings or the second pair of bearings and the at least one seal, wherein the vents are configured to apply a vacuum between the at least one of the first pair of bearings or the second pair of bearings and the at least one seal.

9. An engine comprising:

a rotary valve assembly comprising:

a valve housing defining a cylindrical bore, an inlet, and an outlet;

an intake assembly configured to be at least partially received within the cylindrical bore of the valve housing, wherein the intake assembly comprises an intake body defining a cylindrical bore and having at least one intake inlet port and at least one intake chamber port; and a throttle assembly configured to be at least partially received within the cylindrical bore of the intake assembly, wherein the throttle assembly comprises a throttle body defining at least one throttle inlet port and at least one throttle chamber port;

wherein the throttle assembly and the intake assembly are concentric with respect to a longitudinal axis, wherein the throttle assembly and the intake assembly are configured to rotate independently of one another about the longitudinal axis, wherein the at least one intake chamber port and the at least one throttle chamber port at least partially overlap in a longitudinal direction, wherein the at least one intake inlet port and the at least one throttle inlet port at least partially overlap in the longitudinal direction, and a chamber housing comprising a chamber therein, wherein the valve housing is rigidly attached to the chamber housing, and wherein the rotary valve assembly is in fluid communication with the chamber via an intake housing outlet chamber port, wherein, during operation of the engine, the valve housing is configured to permit fluid to enter the cylindrical bore of the valve housing via the inlet, the intake assembly is configured to rotate to permit the fluid to flow through the at least one intake inlet port and the at least one throttle inlet port into the throttle body, and the intake assembly is configured to permit the fluid to flow to the outlet and into the chamber from the throttle body through the at least one throttle chamber port and the at least one intake chamber port, and wherein the at least one intake chamber port comprises a greater number of ports than the at least one throttle chamber port.

10. The engine of claim 9, wherein the engine consists of one of a uniflow engine, a semi-uniflow engine, or a counter flow engine.

11. The engine of claim 9, further comprising at least one throttle bearing between the intake body and the throttle body; at least one seal between the at least one throttle bearing and at least one of the at least one intake inlet port, the at least one throttle inlet port, the at least one intake chamber port, or the at least one throttle chamber port; and vents disposed between the at least one throttle bearing and the at least one seal, wherein the vents are configured to apply a vacuum between the at least one throttle bearing and the at least one seal.

12. The engine of claim 9, further comprising a first pair of bearings between the bore of the valve housing and the intake assembly at a first end of the intake assembly, and a second pair of bearings between the bore of the valve housing and the intake assembly at a second end of the intake assembly, the rotary valve assembly further comprising at least one seal between the at least one of the first pair of bearings or the second pair of bearings and at least one of the at least one intake inlet port, the at least one throttle inlet port, the at least one intake chamber port, or the at least one throttle chamber port, the rotary valve assembly further comprising vents disposed between the at least one of the first pair of bearings or the second pair of bearings and the at least one seal, wherein the vents are configured to apply a vacuum between the at least one of the first pair of bearings or the second pair of bearings and the at least one seal.

13. The engine of claim 9, wherein the valve housing further comprises an exhaust cylindrical bore, wherein the rotary valve assembly further comprises an exhaust assembly configured to be at least partially received within the exhaust cylindrical bore of the valve housing, wherein the exhaust assembly comprises an exhaust body defining a cylindrical bore and having at least one exhaust outlet port and at least one exhaust chamber port.

14. The engine of claim 9, wherein the valve housing of the rotary valve assembly and the chamber housing are integrally connected.

15. A method for controlling flow of a working fluid into an engine chamber using a rotary valve assembly, the rotary valve assembly comprising a valve housing defining a cylindrical bore, an inlet, and an outlet; an intake assembly configured to be at least partially received within the cylindrical bore of the valve housing, wherein the intake assembly comprises an intake body defining a cylindrical bore and having at least one intake inlet port and at least one intake chamber port; and a throttle assembly configured to be at least partially received within the cylindrical bore of the intake assembly, wherein the throttle assembly comprises a throttle body defining at least one throttle inlet port and at least one throttle chamber port; wherein the throttle assembly and the intake assembly are concentric with respect to a longitudinal axis, wherein the throttle assembly and the intake assembly are configured to rotate independently of one another about the longitudinal axis, wherein the at least one intake inlet port and the at least one throttle inlet port at least partially overlap in the longitudinal direction, and wherein the at least one intake chamber port and the at least one throttle chamber port at least partially overlap in a longitudinal direction; the method comprising:

receiving working fluid into the bore of the valve housing through the inlet, wherein the intake assembly is disposed in the bore;

rotating the intake body of the rotary valve in the bore such that the at least one intake inlet port of the inlet assembly at least partially aligns with the inlet of the valve housing and the at least one throttle inlet port to receive the working fluid within the throttle body;

wherein during the rotation of the intake body of the intake assembly, the at least one intake chamber port at least partially aligns with the at least one throttle chamber port and the outlet of the valve housing, wherein when the at least one intake chamber port, the at least one throttle chamber port, and the outlet of the valve housing at least partially align, the working fluid is directed into the engine chamber, and wherein the at least one intake chamber port comprises a greater number of ports than the at least one throttle chamber port.

16. The method of claim 15, wherein the throttle assembly is stationary during rotation of the intake body, such that the intake body rotates relative to the bore of the valve housing and the throttle assembly, and wherein the throttle assembly is configured to be rotated independently of the intake body during operation to control cutoff of the rotary valve assembly.

17. The method of claim 15, wherein rotating the intake body further comprises rotating the intake body at a rotational speed less than or equal to a rotational speed of an output power shaft of the engine.

18. The method of claim 15, wherein the rotary valve assembly further comprises at least one throttle bearing between the intake body and the throttle body; at least one seal between the at least one throttle bearing and at least one of the at least one intake inlet port, the at least one throttle inlet port, the at least one intake chamber port, or the at least one throttle chamber port; and vents disposed between the at least one throttle bearing and the at least one seal; the method further comprising applying a vacuum via the vents between the at least one throttle bearing and the at least one seal.

* * * * *